US008944180B2

(12) United States Patent
Ikuta et al.

(10) Patent No.: US 8,944,180 B2
(45) Date of Patent: Feb. 3, 2015

(54) POWER TOOL WITH A TORQUE TRANSMITTING MECHANISM

(75) Inventors: Hiroki Ikuta, Anjo (JP); Tomohiro Ukai, Anjo (JP); Yuta Matsuura, Anjo (JP); Yosuke Nishio, Anjo (JP)

(73) Assignee: Makita Corporation, Anjo-shi (JP)

( * ) Notice: Subject to any disclaimer, the term of this patent is extended or adjusted under 35 U.S.C. 154(b) by 447 days.

(21) Appl. No.: 13/333,367

(22) Filed: Dec. 21, 2011

(65) Prior Publication Data

US 2012/0160530 A1 Jun. 28, 2012

(30) Foreign Application Priority Data

Dec. 27, 2010 (JP) ..... 2010-290446

(51) Int. Cl.
*B25B 21/00* (2006.01)
*B25F 5/00* (2006.01)

(52) U.S. Cl.
CPC ..... *B25B 21/00* (2013.01); *B25F 5/001* (2013.01)
USPC ..... 173/13; 173/146

(58) Field of Classification Search
CPC .... B25B 1/00; B25B 23/0064; B25B 21/007; B25B 23/147; F16D 7/028; F16D 1/10; F16D 7/042; B25F 5/00
USPC ..... 173/13, 146
See application file for complete search history.

(56) References Cited

U.S. PATENT DOCUMENTS

| | | | | |
|---|---|---|---|---|
| 1,679,155 | A | 7/1926 | Connell | |
| 2006/0233622 | A1 * | 10/2006 | Bauman | 408/239 R |
| 2007/0034394 | A1 | 2/2007 | Gass et al. | |
| 2011/0048752 | A1 | 3/2011 | Sato | |

FOREIGN PATENT DOCUMENTS

| | | | | |
|---|---|---|---|---|
| GB | 2146562 | A * | 4/1985 | B25B 21/00 |
| JP | U-51-152199 | | 12/1976 | |
| JP | A-62-48471 | | 3/1987 | |
| JP | A-09-011148 | | 1/1997 | |
| JP | A-2009-101500 | | 5/2009 | |

OTHER PUBLICATIONS

May 29, 2014 Office Action issued in Japanese Patent Application No. 2010-290446.
Apr. 1, 2014 Search Report issued in European Patent Application No. 11195512.6.
Sep. 18, 2014 Office Action issue din Japanese Patent Application No. 2010-290446 (with translation).

* cited by examiner

*Primary Examiner* — Michelle Lopez
(74) *Attorney, Agent, or Firm* — Oliff PLC

(57) ABSTRACT

The power tool has a power transmitting mechanism. When a tool bit is not pressed against a workpiece, the power transmitting mechanism is held in a power transmission interrupted state, and when the tool bit is pressed against the workpiece, the power transmitting mechanism is held in a power transmission state in which the tool bit moves together with the driven-side member in an axial direction of the tool bit so that the driving-side member receives the torque from the driven-side member and the tool bit is driven. Tapered portions are provided between the driving-side member and the driven-side member and inclined with respect to the axial direction of the tool bit. When the driven-side member moves in the axial direction of the tool bit, frictional force is caused on the tapered portions and the torque of the driving-side member is transmitted to the driven-side member by the frictional force.

9 Claims, 19 Drawing Sheets

POWER TOOL WITH A TORQUE TRANSMITTING MECHANISM

BACKGROUND OF THE INVENTION

1. Field of the Invention

The present invention relates to a power tool that performs a predetermined operation by driving a tool bit.

2. Description of the Related Art

Japanese laid-open patent publication No. 2009-101500 discloses a screw tightening machine having a multi-plate friction clutch mechanism in which a plurality of friction plates are layered in its longitudinal direction between a driving part which is driven by a driving motor and a driven part to which a tool bit is attached. According to the screw tightening machine having the above-described construction, when the tool bit in the form of a bit is pressed against a head of a screw, a plurality of clutch plates come in contact with each other by reaction force caused by this pressing operation and frictional force is caused. As a result, torque of the driving part is transmitted to the bit via the multi-plate friction clutch mechanism and a screw tightening operation is performed by the bit.

Because the multi-plate friction clutch mechanism disclosed in the above-described publication requires a certain number of clutch plates in order to transmit a certain torque, a number of clutch plates are layered in the longitudinal direction. As a result, the length of a tool body tends to increase in the longitudinal direction, and when the above-described pressing operation is released, the clutch plates tend to be kept in contact with each other and easily cause dragging. In this point, further improvement is desired.

SUMMARY OF THE INVENTION

Accordingly, it is an object of the present invention to provide a power tool that contributes to size reduction of a tool body.

In order to solve the above-described problem, according to a preferred embodiment of the present invention, a power tool is provided which performs a predetermined operation on a workpiece by driving a tool bit. The power tool of the present invention includes a prime mover that drives the tool bit and a power transmitting mechanism that transmits torque of the prime mover to the tool bit. The power transmitting mechanism has a driving-side member which is rotationally driven by the prime mover, and a driven-side member to which the tool bit is coupled. When the tool bit is not pressed against the workpiece, the power transmitting mechanism is held in a power transmission interrupted state in which torque of the driving-side member is not transmitted to the driven-side member. Further, when the tool bit is pressed against the workpiece, the power transmitting mechanism is held in a power transmission state in which the tool bit moves together with the driven-side member in an axial direction of the tool bit so that the driving-side member receives the torque from the driven-side member and the tool bit is driven. Further, a tapered portion is provided between the driving-side member and the driven-side member and inclined with respect to the axial direction of the tool bit. When the driven-side member moves in the axial direction of the tool bit, frictional force is caused on the tapered portion and the torque of the driving-side member is transmitted to the driven-side member by this frictional force. Further, the "predetermined operation" in the present invention widely includes a screw tightening operation by rotationally driving the tool bit in the form of a driver bit, a drilling operation by rotation of a drill, a grinding/polishing operation by rotation or eccentric rotation of a grinding wheel or an abrasive, and other similar operations.

The power transmitting device of the present invention serves as a friction clutch which transmits torque from the driving-side member to the driven-side member by frictional force caused on the tapered portion. With such a construction, noise and wear can be avoided which may be caused in the case of a claw clutch in which claws hit each other upon clutch engagement, so that durability can be improved. Further, increase of the length of the power tool in the longitudinal direction can be avoided which may be caused in the case of a multiplate friction clutch in which a number of friction plates are layered in the longitudinal direction. Thus, the power tool can be provided in reduced size in the longitudinal direction.

According to a further aspect the present invention, a pushing force is caused by pressing the driven-side member against the workpiece and amplified, and the amplified force acts on the tapered portion in a direction perpendicular to the axial direction.

According to this aspect, the force to which the pushing force is amplified is caused on the tapered portion, so that higher frictional force can be obtained and the power transmitting performance can be enhanced. In this case, in order to amplify the pushing force, the inclination angle of the tapered portion with respect to the axial direction of the tool bit is preferably set to an angle over zero and below 45 degrees, and more preferably to 20 degrees or below.

According to a further aspect of the present invention, an intervening member is provided between the driving-side member and the driven-side member and can be engaged with the both members. Further, by frictional contact of the intervening member with the tapered portion, the torque of the driving-side member is transmitted to the driven-side member via the intervening member.

According to this aspect, the torque of the driving-side member can be transmitted to the driven-side member via the intervening member.

According to a further aspect of the present invention, the intervening member is configured as a planetary member that revolves around an axis of the driving-side member, and the driven-side member is rotated by revolving movement of the planetary member.

According to this aspect, with the construction in which the intervening member is formed by the planetary member that is caused to revolve around the axis of the driving-side member, the rotation speed of the driving-side member can be changed and transmitted to the driven-side member.

According to a further aspect of the present invention, the power transmitting mechanism includes a fixed sun member having an outer circumferential surface, an outer ring member that is disposed coaxially with the sun member and has an inner circumferential surface opposed to the outer circumferential surface of the sun member with a predetermined space, the intervening member in the form of the planetary member that is disposed between the outer circumferential surface of the sun member and the inner circumferential surface of the outer ring member and can revolve on the outer circumferential surface of the sun member, and a carrier for holding the planetary member. Further, the outer ring member and the carrier form the driving-side member and the driven-side member, respectively, and the tapered portion is provided between the sun member and the driving-side member.

According to this aspect, with the construction in which the power transmitting mechanism serves both as a friction clutch and a planetary gear speed reducing mechanism, the entire mechanism can be reduced in size compared with a construction in which these two functions are separately provided.

According to a further aspect of the present invention, the driving-side member and the driven-side member are caused to move together in the axial direction. By movement of the driving-side and driven-side members in one direction along the axial direction, the planetary member comes in frictional contact with the tapered portion so that the torque of the driving-side member is transmitted to the driven-side member. Further, by movement of the driving-side and driven-side members in the other direction, the frictional contact of the planetary member with the tapered portion is released so that the torque transmission is interrupted.

According to this aspect, transmission and interruption of torque from the driving-side member to the driven-side member is made by synchronized movement of the driving-side member and the driven-side member.

According to a further aspect of the present invention, the power tool is configured as a screw tightening tool having the tool bit in the form of a driver bit that performs a screw tightening operation on a workpiece, and the power tool has a tool body and a locator that is disposed on a front end of the tool body and regulates a penetration depth of a screw to be tightened by the driver bit. In the screw tightening operation, when the locator comes in contact with the workpiece, the driven-side member is moved forward together with the driver bit, so that frictional force on the tapered portion is released.

According to this aspect, the screw tightening operation can be completed when the screw reaches a predetermined penetration depth during screw tightening operation.

According to a further aspect of the present invention, the power tool is configured as a grinding/polishing tool having a tool bit in the form of a grinding wheel or abrasive that performs a grinding/polishing operation.

According to this aspect, torque is transmitted to the tool bit when the tool bit is pressed against the workpiece, while transmission of the torque to the tool bit is interrupted when the pressing force is released. Therefore, the user can perform the grinding/polishing operation by pressing the tool bit against the workpiece and can stop the operation by releasing the pressing force.

According to the present invention, a power tool is provided which contributes to improvement of size reduction of a tool body. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power tools and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

(First Embodiment of the Invention)

Figure 1:
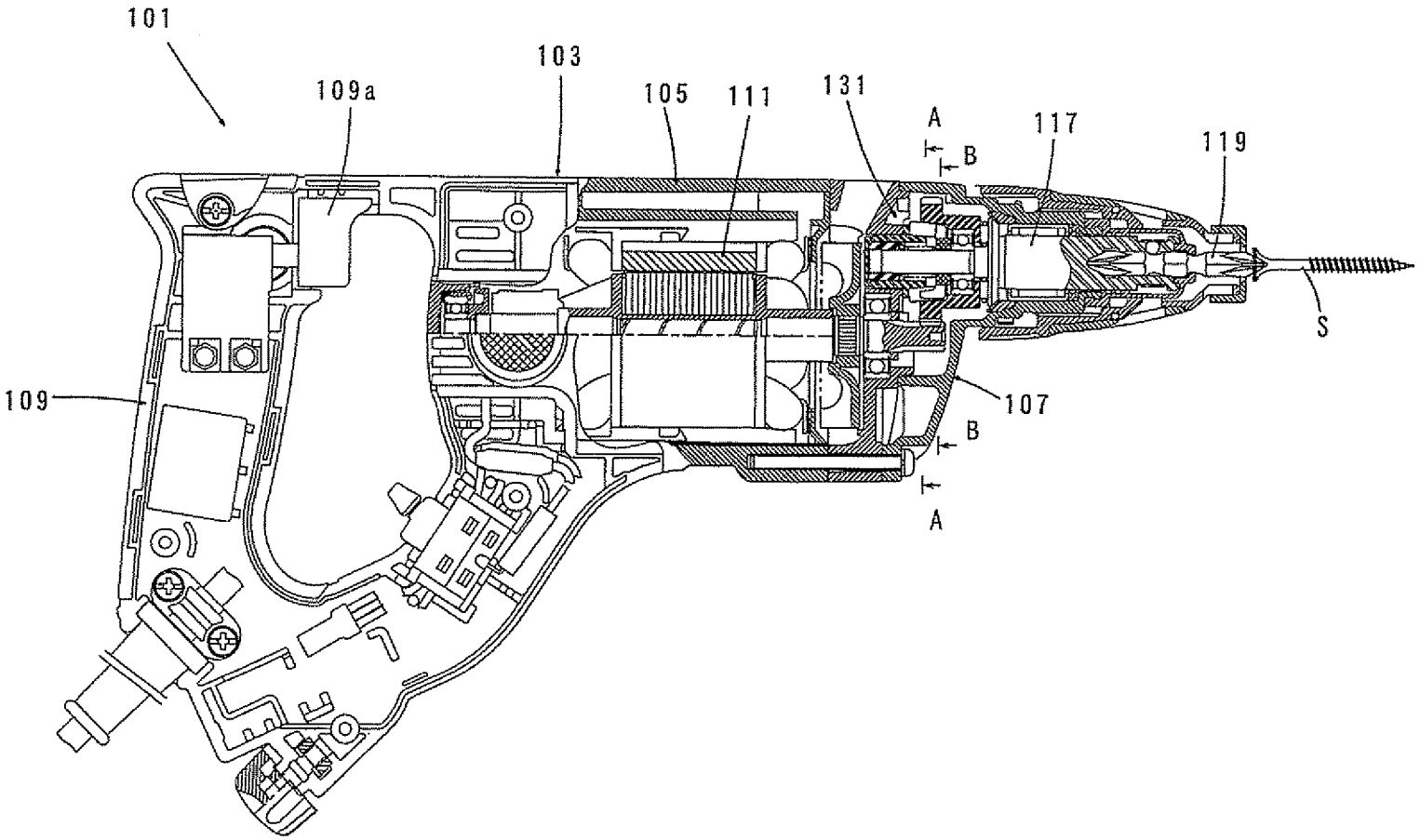
FIG. 1 is a sectional side view schematically showing an entire screwdriver according to a first embodiment of the present invention.

An embodiment of the present invention is now described with reference to FIGS. 1 to 7. An entire electric screwdriver is described as a representative embodiment of the power tool according to the present invention. FIG. 1 shows an entire electric screwdriver 101. As shown in FIG. 1, the screwdriver 101 according to this embodiment mainly includes a power tool body in the form of a body 103, a driver bit 119 detachably coupled to a front end region (right end region as viewed in FIG. 1) of the body 103 via a spindle 117, and a handgrip 109 connected to the body 103 on the side opposite to the driver bit 119. The driver bit 119 is a feature that corresponds to the "tool bit" according to the present invention. Further, in this embodiment, for the sake of convenience of explanation, the side of the driver bit 119 is taken as the front and the side of the handgrip 109 as the rear.

The body 103 mainly includes a motor housing 105 that houses a driving motor 111, and a gear housing 107 that houses a power transmitting mechanism 131. The driving motor 111 is driven when a trigger 109*a* on the handgrip 109 is depressed, and stopped when the trigger 109*a* is released. The driving motor 111 is a feature that corresponds to the "prime mover" according to the present invention.

Figure 3:
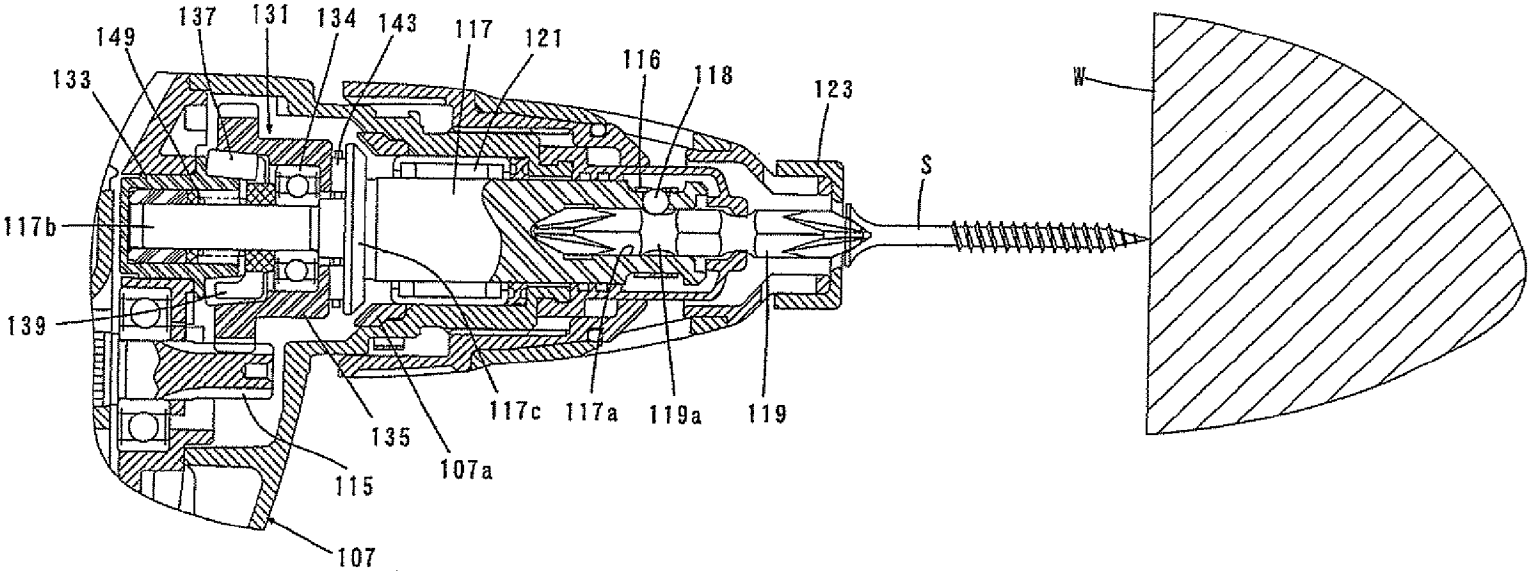
FIG. 3 is an enlarged view of an essential part of FIG. 1, in a state in which a screw tightening operation has just started (showing a power transmission state in which a spindle is pushed in together with a driver bit and torque of a driving motor is transmitted to the spindle).

As shown in FIG. 3, the spindle 117 is mounted to the gear housing 107 via a bearing 121 such that it can move in its longitudinal direction with respect to the gear housing 107 and can rotate around its axis. The spindle 117 has a bit insertion hole 117*a* on its tip end portion (front end portion). The driver bit 119 having a small-diameter portion 119*a* is inserted into the bit insertion hole 117*a*, and a steel ball 118 is biased by a ring-like leaf spring 116 and engaged with the small-diameter portion 119*a*. In this manner, the spindle 117 detachably holds the driver bit 119.

Figure 2:
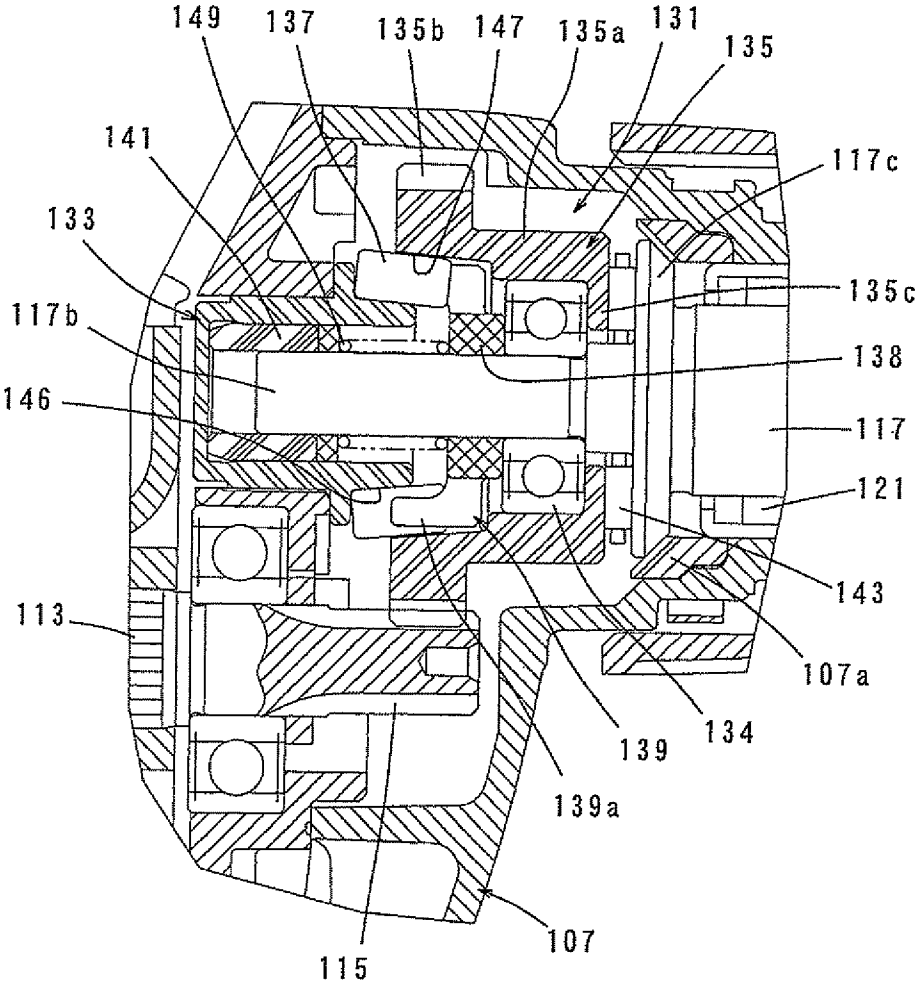
FIG. 2 is an enlarged view of an essential part of FIG. 1, in an initial state.

As shown in FIG. 2, the power transmitting mechanism 131 for transmitting rotating output of the driving motor 111 to the spindle 117 mainly includes a radial friction clutch of a planetary roller type. The power transmitting mechanism 131 mainly includes a fixed hub 133, a driving gear 135, a plurality of columnar rollers 137 disposed between the fixed hub 133 and the driving gear 135, and a roller holding member 139 for holding the rollers 137.

The fixed hub 133 corresponds to a sun member of a planetary gear speed reducing mechanism, and is disposed rearward of the spindle 117 and fixed to the gear housing 107. The driving gear 135 corresponds to an outer ring member of the planetary gear speed reducing mechanism and is disposed forward of the fixed hub 133. Further, the driving gear 135 is mounted on a rear portion of the spindle 117 via a bearing (radial ball bearing) 134 such that it is allowed to rotate with respect to the spindle 117 and prevented from moving in the longitudinal direction with respect to the spindle. The columnar rollers 137 correspond to a planetary member of the planetary gear speed reducing mechanism and are disposed between an inner circumferential surface of the driving gear 135 and an outer circumferential surface of the fixed hub 133. The roller holding member 139 corresponds to a carrier of the planetary gear speed reducing mechanism, and holds the rollers 137 such that the rollers can rotate. Further, the roller holding member 139 is fixed to the spindle 117 and rotates together with the spindle 117. The driving gear 135, the rollers 137 and the roller holding member 139 are features that correspond to the "driving-side member", the "intervening member" and the "driven-side member", respectively, according to the present invention.

The driving gear 135 has a generally cup-like form and has teeth 135*b* formed in an outer periphery of an open end portion of a barrel part 135*a* which forms a circumferential wall of the driving gear 135. The teeth 135*b* are constantly engaged with a pinion gear 115 formed on a motor shaft 113 of the driving motor 111. Further, a circular through hole is formed in the center of a bottom wall of the driving gear 135. The roller holding member 139 is disposed between the fixed hub 133 and the driving gear 135. The roller holding member 139 has a generally cylindrical shape, and a barrel part 139*a* forming a circumferential wall of the roller holding member 139 holds the rollers 137 such that the rollers can rotate. Further, a retainer ring 138 is fixedly mounted to one axial end (front end) of the roller holding member 139. The spindle 117 has a small-diameter shank 117*b* on its one end (rear end) and the small-diameter shank 117*b* is inserted into a bore of the fixed hub 133 through the through hole of the driving gear 135 and a ring hole of the retainer ring 138 of the roller holding member 139. The small-diameter shank 117*b* is loosely fitted through the through hole of the driving gear 135 and press-fitted through the ring hole of the retainer ring 138 and supported in the bore of the fixed hub 133 via a bearing (bush) 141 such that it can move in the longitudinal direction. The roller holding member 139 is integrated with the spindle 117 by press-fitting the small-diameter shank 117*b* of the spindle 117 through the retainer ring 138.

Further, a flange 117*c* is formed substantially in the middle of the spindle 117 in the longitudinal direction and faces a front surface of a bottom wall 135*c* of the driving gear 135. Further, a bearing (thrust roller bearing) 143 is disposed between a rear surface of the flange 117*c* and a front surface of the bottom wall of the driving gear 135 and receives a thrust load. A bearing 134 is disposed inside the driving gear 135 on the rear surface of the bottom wall. Thus the driving gear 135 is held between the bearings 134 and 143 from the front and the rear in the axial direction and supported such that it can rotate with respect to the spindle 117 and move together with the spindle 117 in the longitudinal direction. Further, the bearing 134 is prevented from slipping off by a front surface of the retainer ring 138 for the roller holding member 139 fixed to the small-diameter shank 117*b* of the spindle 117. The fixed hub 133, the driving gear 135, the roller holding member 139 and the spindle 117 are coaxially disposed.

Figure 6:
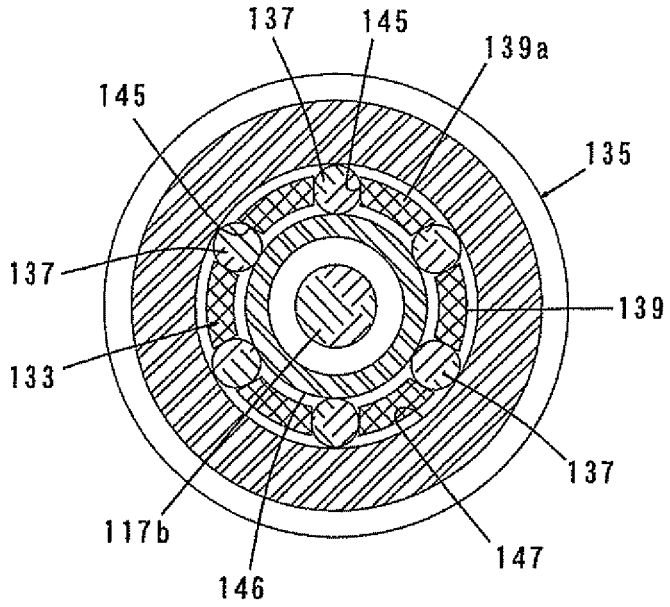
FIG. 6 is a sectional view taken along line A-A in FIG. 1.
Figure 7:
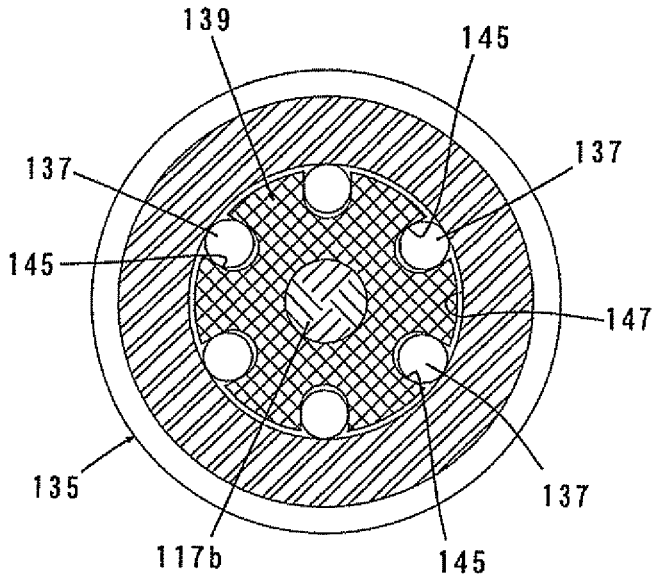
FIG. 7 is a sectional view taken along line B-B in FIG. 1.

As shown in FIGS. 6 and 7, a plurality of axially extending roller installation grooves 145 each having a closed front end are formed in the barrel part 139*a* of the roller holding member 139 at predetermined (equal) intervals in the circumferential direction. The rollers 137 are loosely fitted in the roller installation grooves 145. Thus, the rollers 137 are held by the roller holding member 139 such that the rollers are allowed to rotate within the roller installation grooves 145 and move in the radial direction of the spindle 117, but they are prevented from moving in the circumferential direction with respect to the spindle 117.

As shown in FIG. 2, the fixed hub 133 and the driving gear 135 are opposed to each other on opposite sides of the roller holding member 139 in the longitudinal direction of the spindle 117. The barrel part 135*a* of the driving gear 135 has an inner diameter larger than an outer diameter of the fixed hub 133, and a rear end portion of the barrel part 135*a* is disposed over an outer surface of a front end portion of the fixed hub 133. Thus, the outer circumferential surface of the fixed hub 133 and the inner circumferential surface of the barrel part 135*a* of the driving gear 135 are opposed to each other in the radial direction transverse to the longitudinal direction of the driving gear 135 (the longitudinal direction of the spindle 117). The outer circumferential surface of the fixed hub 133 and the inner circumferential surface of the barrel part 135*a* of the driving gear 135 are formed as tapered surfaces (conical surfaces) 146, 147 which are inclined at a predetermined angle with respect to the longitudinal direction of the driving gear 135 and extend parallel to each other. The tapered surface 146 of the fixed hub 133 and the tapered surface 147 of the driving gear 135 are features that correspond to the "tapered portion" according to the present invention. The tapered surface 146 of the fixed hub 133 is tapered forward (toward the driver bit), and the tapered surface 147 of the driving gear 135 is also tapered forward.

As shown in FIGS. 2 and 6, the rollers 137 held in the roller installation grooves 145 are disposed between the tapered surface 146 of the fixed hub 133 and the tapered surface 147 of the barrel part 135*a* of the driving gear 135, and part of the outer surface of each of the rollers 137 protrudes from the inner and outer surfaces of the barrel part 139*a* of the roller holding member 139. Further, the roller 137 is configured as a parallel roller and placed substantially in parallel to the tapered surface 146 of the fixed hub 133 and the tapered surface 147 of the driving gear 135 when disposed between the tapered surfaces 146, 147. Therefore, when the rollers 137 are moved rearward together with the roller holding member 139 and the driving gear 135 against a biasing force of a compression coil spring 149 which is described below, by pressing the driver bit 119 against the workpiece, the distance between the tapered surface 146 of the fixed hub 133 and the tapered surface 147 of the driving gear 135 is decreased, so that the rollers 137 are pressed against the tapered surfaces 146, 147. Specifically, the rollers 137 serve as a wedge between the tapered surface 146 of the fixed hub 133 and the tapered surface 147 of the driving gear 135 which are moved relative to each other in the longitudinal direction of the spindle 117. Thus, frictional force is caused on the contact surfaces between the tapered surfaces 146, 147 and the rollers 137, and the rollers 137 revolve around the axis of the fixed hub 133 whiling rotating. Thus, the roller holding member 139 holding the rollers 137 and the spindle 117 are caused to rotate. Specifically, the torque of the driving gear 135 is transmitted to the roller holding member 139 via the rollers 137, and then the roller holding member 139 and the spindle 117 are caused to rotate at reduced speed in the same direction as the direction of rotation of the driving gear 135. The state in which the torque of the driving gear 135 is transmitted to the roller holding member 139 via the rollers 137 is a feature that corresponds to the "operating state" according to the present invention.

A biasing member in the form of the compression coil spring 149 which serves to release frictional contact is disposed between the roller holding member 139 and the bearing 141 for receiving the rear end of the spindle 117, and the roller holding member 139, the driving gear 135 and the spindle 117 are constantly biased forward by the compression coil spring 149. Therefore, when the driver bit 119 is not pressed against the workpiece, the roller holding member 139, the driving gear 135 and the spindle 117 are placed in a forward position and the distance between the tapered surface 146 of the fixed hub 133 and the tapered surface 147 of the driving gear 135 is increased. In this state, the rollers 137 held by the roller holding member 139 are no longer pressed against the tapered surface 146 of the fixed hub 133 or the tapered surface 147 of the driving gear 135, so that frictional force is not caused. Specifically, when the driver bit 119 is not pressed against the workpiece, the torque of the driving gear 135 is not transmitted to the roller holding member 139. This state is a feature that corresponds to the "power transmission interrupted state" according to the present invention. In this power transmission interrupted state, even if the driving motor 111 is driven and the driving gear 135 is rotationally driven, the torque of the driving gear 135 is not transmitted to the roller holding member 139, or specifically, the driving gear 135 idles. Further, when the roller holding member 139 is moved to the forward (non-pressed) position by the compression coil spring 149, the flange 117*c* of the spindle 117 comes in contact with a stopper 107*a* formed on an inner wall surface of the gear housing 107, so that the roller holding member 139 is held in the forward (non-pressed) position.

The power transmitting mechanism 131 according to this embodiment which is constructed as described above serves as a speed reducing mechanism to transmit rotation of a driving-side member in the form of the driving gear 135 to a driven-side member in the form of the roller holding member 139 and the spindle 117 via an intervening member in the form of the rollers 137 at reduced speed, and also serves as a friction clutch to transmit torque and interrupt the torque transmission between the driving gear 135 and the roller holding member 139.

Operation of the electric screwdriver 101 constructed as described above is now explained. FIG. 2 shows an initial state in which a screw tightening operation is not yet performed (the driver bit 119 is not pressed against the workpiece). In this initial state, the roller holding member 139 is held in a forward position by the compression coil spring 149. Therefore, the rollers 137 are separated from the tapered surfaces 146, 147 and frictional force is not caused between the rollers 137 and the tapered surfaces 146, 147. When the driving motor 111 (see FIG. 1) is driven by depressing the trigger 109*a* (see FIG. 1), the driving gear 135 idles and the spindle 117 is not rotationally driven in the idling state. In this idling state, the compression coil spring 149 is not rotated, so that friction heating is not caused.

Specifically, when the driver bit 119 is not pressed against the workpiece, or when the rollers 137 are separated from the tapered surfaces 146, 147 (the rollers 137 are not pressed against the tapered surfaces 146, 147) by the biasing force of the compression coil spring 149, the power transmitting mechanism 131 of this embodiment is normally held in the idling state. In the idling state, even if the trigger 109*a* is depressed to drive the driving motor 111 and rotationally drive the driving-side member in the form of the driving gear 135, the torque of the driving gear 135 is not transmitted to the driven-side member in the form of the roller holding member 139.

In the above-described idling state, when a user moves the body 103 forward (toward the workpiece) and presses the screw S set on the driver bit 119 against the workpiece W in order to perform the screw tightening operation, the driver bit 119, the spindle 117, the roller holding member 139 and the driving gear 135 are pushed together toward the body 103 while compressing the compression coil spring 149. Specifically, they retract (move to the left as viewed in the drawings) with respect to the body 103. By the rearward movement of the driving gear 135, the distance between the tapered surface 147 of the driving gear 135 and the tapered surface 146 of the fixed hub 133 is decreased, so that the rollers 137 held by the roller holding member 139 are held between the tapered surfaces 146, 147 and pressed against the tapered surfaces 146, 147. As a result, frictional force is caused on contact surfaces (lines) between the rollers 137 and the tapered surfaces 146, 147 by the wedge action of the rollers, so that the rollers 137 are caused to revolve while rotating on the tapered surface 146 of the fixed hub 133 by rotation of the driving gear 135. Therefore, the roller holding member 139, the spindle 117 and the driver bit 119 are caused to rotate together in the same direction as the driving gear 135 at reduced speed lower than the rotation speed of the driving gear 135. Thus, an operation of driving the screw S into the workpiece W is started. FIG. 3 shows a state immediately after starting the screw tightening operation.

Figure 4:
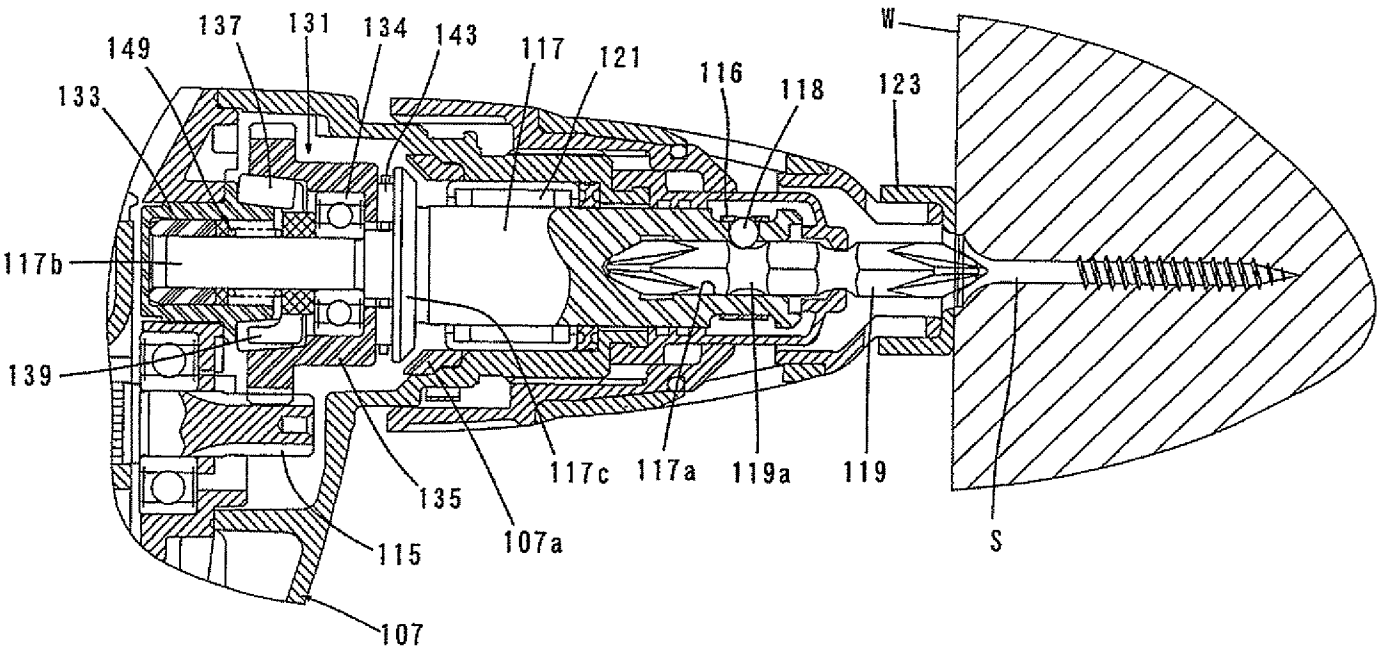
FIG. 4 is the enlarged view of the essential part of FIG. 1, in a state in which a locator for regulating a screw penetration depth is in contact with a workpiece.
Figure 5:
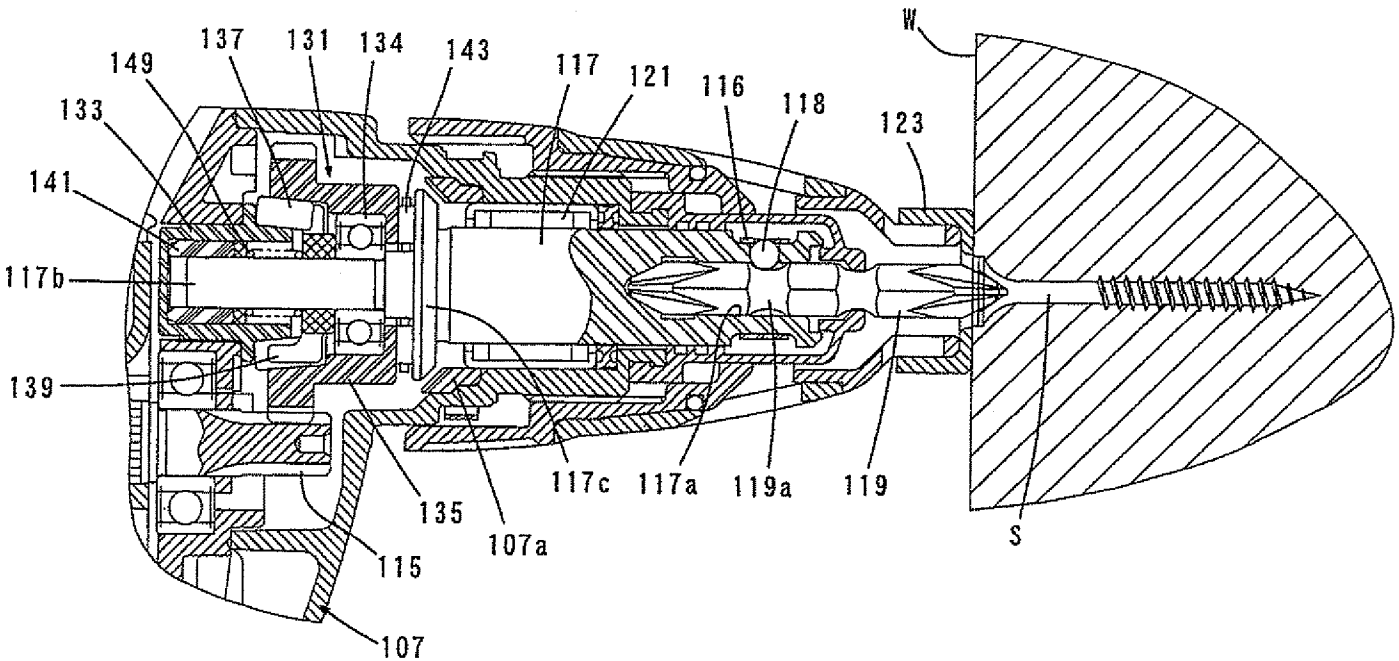
FIG. 5 is the enlarged view of the essential part of FIG. 1, in a state of completion of the screw tightening operation.

A locator 123 for regulating a screw penetration depth is mounted on the front end of the body 103. When the operation of driving the screw S into the workpiece W proceeds and a front end of the locator 123 comes in contact with the workpiece W as shown in FIG. 4, the locator 123 prevents the body 103 from further moving toward the workpiece W. Specifically, the locator 123 prevents the body 103 from moving toward the workpiece W over a point at a predetermined distance from the workpiece W. In this state in which the body 103 is prevented from further moving toward the workpiece W by the locator 123, the driver bit 119 further continues to rotate and the screw S is driven in. Therefore, the driver bit 119, the spindle 117 and the roller holding member 139 are caused to move toward the workpiece W with respect to the body 103 by the biasing force of the compression coil spring 149. By this movement, the rollers 137 are no longer pressed against the tapered surface 146 of the fixed hub 133 and the tapered surface 147 of the driving gear 135, so that transmission of the torque from the driving gear 135 to the roller holding member 139 is interrupted. As a result, a screw tightening operation by the driver bit 119 is completed. This state is shown in FIG. 5.

In the power transmitting mechanism 131 according to this embodiment, frictional force is caused by pressing the rollers 137 against the tapered surface 146 of the fixed hub 133 and the tapered surface 147 of the driving gear 135 and the torque of the driving gear 135 is transmitted to the roller holding member 139 by this frictional force. With such a construction, the power transmitting mechanism 131 can avoid noise and wear which may be caused in the case of a claw clutch in which claws hit each other upon clutch engagement, so that durability can be improved. Further, the power transmitting mechanism 131 can avoid increase of the length in the longitudinal direction which may be caused in the case of a multiplate friction clutch in which a number of friction plates are layered in the longitudinal direction. Thus, the screwdriver 101 can be provided in which the length of the body 103 in the longitudinal direction is decreased.

According to this embodiment, a pushing force with which the rollers 137 are pushed in between the tapered surface 146 of the fixed hub 133 and the tapered surface 147 of the driving gear 135 by pressing the driver bit 119 against the workpiece is amplified by the wedging effect of the rollers, and the amplified force can act on the tapered surfaces 146, 147 in the radial direction perpendicular to the longitudinal direction of the driving gear 135. With such a construction, higher frictional force can be obtained and the power transmitting performance can be enhanced. In this case, provided that the tapered surfaces 146, 147 have an inclination angle $\theta$ with respect to the longitudinal direction of the driving gear 135 (the longitudinal direction of the spindle 117), this pushing force can be amplified about $(1/\tan\theta)$ time. Therefore, the inclination angle $\theta$ of the tapered surfaces 146, 147 is set to an angle above zero and below 45 degrees, and particularly preferably to 20 degrees or below.

According to this embodiment, the driving gear 135 moves in the longitudinal direction together with the roller holding member 139. With such a construction, the distance between the tapered surface 147 of the driving gear 135 and the tapered surface 146 of the fixed hub 133 is decreased by rearward movement of the driving gear 135 and increased by forward movement of the driving gear 135. Therefore, pressing of the rollers 137 against the tapered surfaces 146, 147 can be made and released only by a small amount of displacement of the driving gear 135.

The power transmitting mechanism 131 according to this embodiment serves as both the friction clutch and the planetary gear speed reducing mechanism, so that the entire mechanism can be reduced in size compared with a construction in which these two functions are separately provided. Further, according to this embodiment, rotation speed is also reduced at the clutch part, so that the speed reduction ratio between the driving gear 135 and the pinion gear 115 can be reduced and the size of the driving gear 135 can be reduced in the radial direction. Therefore, the distance from the axis of the spindle 117 to the body 103, or the center height can be reduced.

(Second Embodiment of the Invention)

Figure 8:
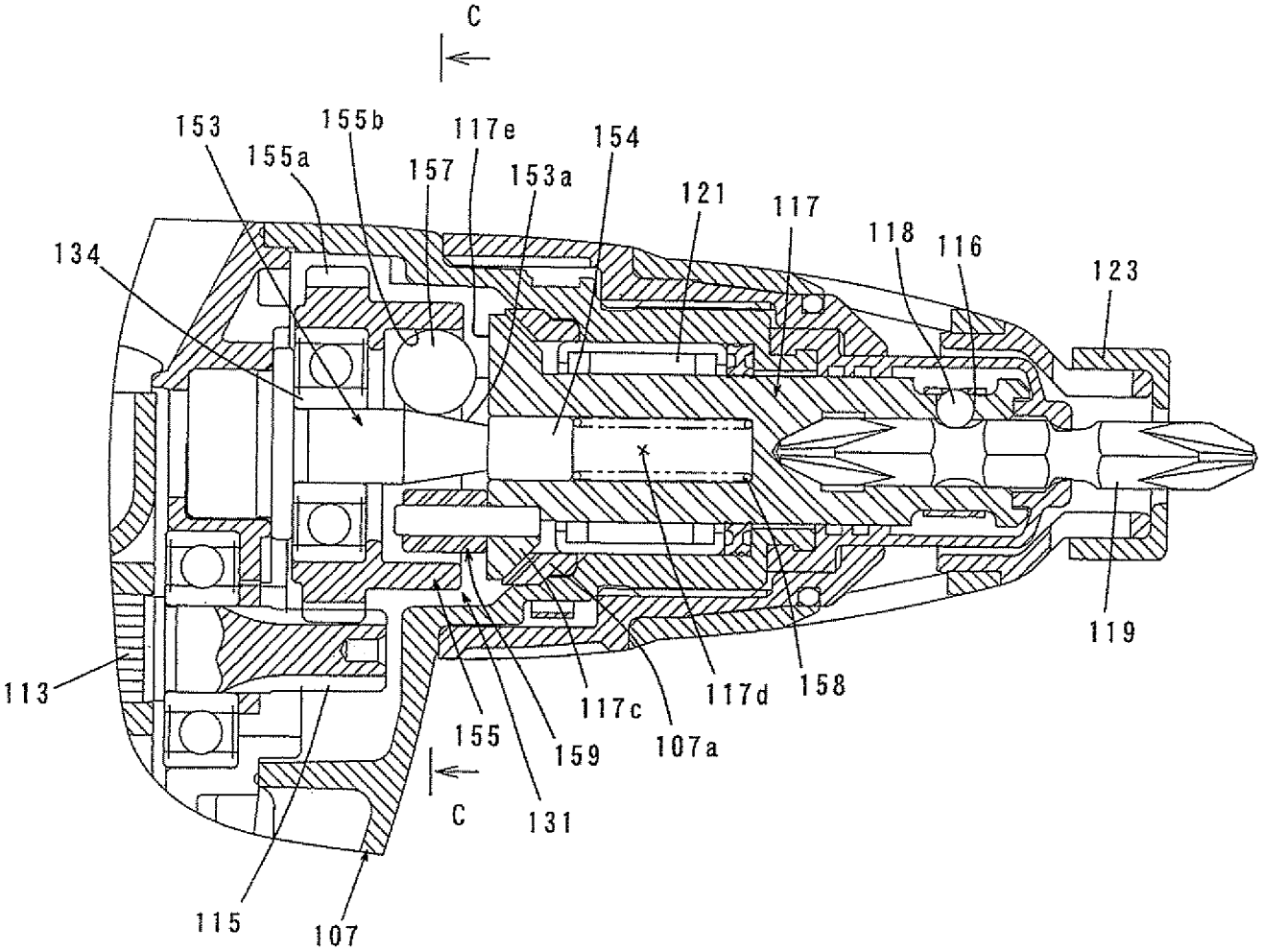
FIG. 8 is a sectional view showing a power transmitting mechanism of a screwdriver according to a second embodiment of the present invention, in an initial state in which power transmission is interrupted.
Figure 9:
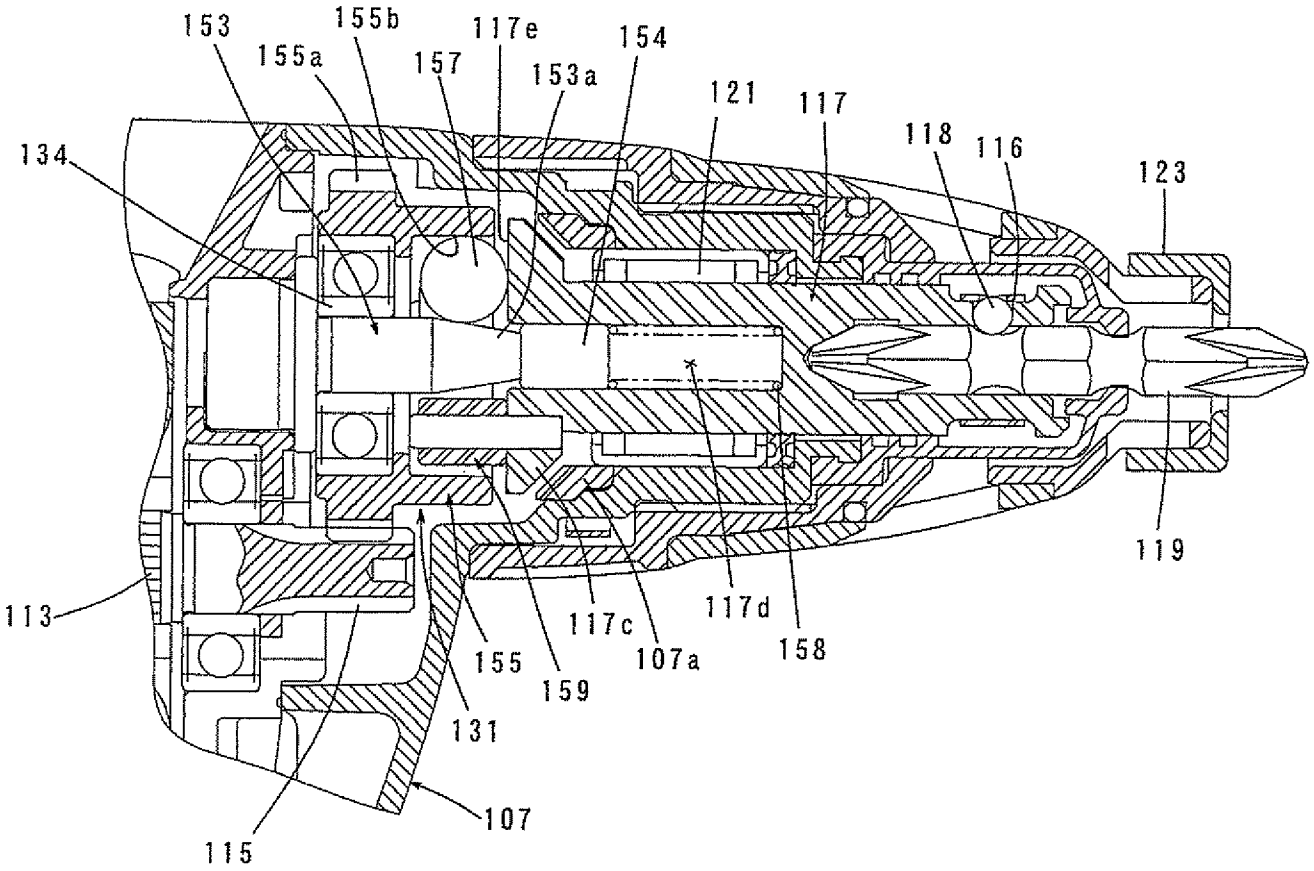
FIG. 9 is also a sectional view showing the power transmitting mechanism in a power transmission state.

A second embodiment of the present invention is now described with reference to FIGS. 8 to 10. This embodiment relates to a modification of the power transmitting mechanism 131 of the screwdriver 101 and mainly includes a radial friction clutch of a planetary ball type. As shown in FIGS. 8 and 9, the power transmitting mechanism 131 has a plurality of balls (steel balls) 157 which correspond to the planetary member of the planetary gear speed reducing mechanism. The balls 157 revolve around a fixed hub 153 which corresponds to the sun member of the planetary gear speed reducing mechanism, while rotating, so that rotation of a driving gear 155 which corresponds to the outer ring member of the planetary gear speed reducing mechanism is transmitted to a ball holding member 159 which corresponds to the carrier of the planetary gear speed reducing mechanism. The driving gear 155, the ball holding member 159 and the balls 157 are features that correspond to the "driving-side member", the "driven-side member" and the "intervening member", respectively, according to the present invention.

The fixed hub 153 is a columnar member (rod-like member) having a conical tapered surface 153 a on its front outer circumferential surface in the longitudinal direction, and disposed at the rear of the spindle 117 on the axis of the spindle 117. Further, a rear end portion of the fixed hub 153 is fixed to the gear housing 107, and a front end shank of the fixed hub 153 is inserted into a longitudinally extending spring receiving hole 117*d* formed in the center of the rear portion of the spindle 117 such that it can rotate and move in the longitudinal direction with respect to the spindle 117. The tapered surface 153*a* of the fixed hub 153 is tapered forward (toward the driver bit) and is a feature that corresponds to the "tapered portion" according to the present invention. Further, the spindle 117 does not have the small-diameter shank 117*b* as described in the first embodiment. The inclination angle of the tapered surface 153*a* with respect to the longitudinal direction of the spindle 117 is set similarly to that of the above-described first embodiment.

The driving gear 155 is formed as a generally cylindrical member and coaxially disposed over the fixed hub 153, and a rear end portion of the driving gear 155 in the axial direction is rotatably mounted on the outer surface of the fixed hub 153 via a bearing 134. Teeth 155*a* are formed in the outer circumferential surface of the barrel of the driving gear 155 and constantly engaged with the pinion gear 115 of the motor shaft 113. Further, a front region of an inner circumferential surface of the barrel of the driving gear 155 forms an inner circumferential surface 155*b* parallel to the longitudinal direction of the spindle 117, and the inner circumferential surface 155*b* is opposed to the tapered surface 153*a* of the fixed hub 153 with a predetermined space.

Figure 10:
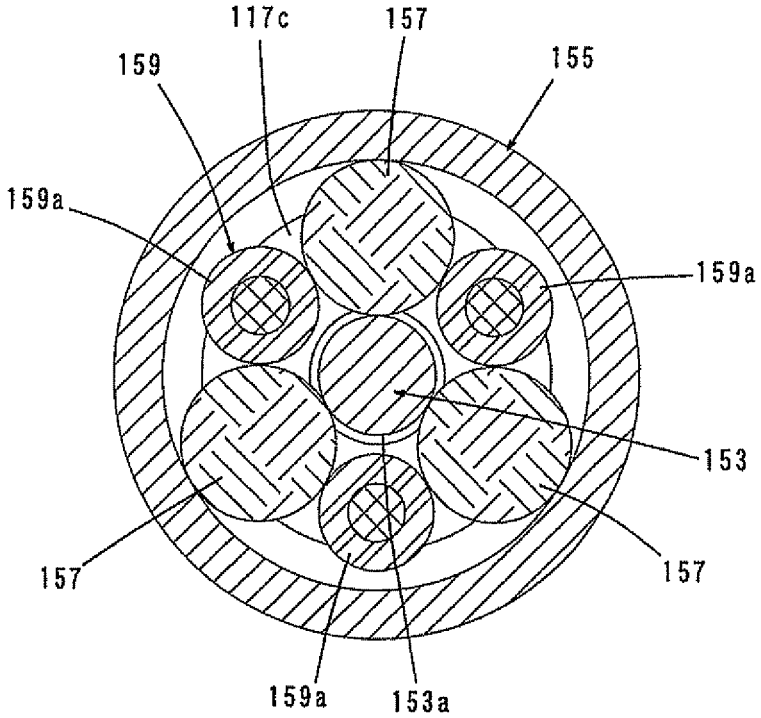
FIG. 10 is a sectional view taken along line C-C in FIG. 8.

As shown in FIG. 10, the balls 157 are disposed between the tapered surface 153*a* of the fixed hub 153 and the inner circumferential surface 155*b* of the driving gear 155. The ball holding member 159 includes a plurality of cylindrical elements 159*a* which are mounted on the rear end of the spindle 117 and spaced at predetermined intervals in the circumferential direction. Further, the ball holding member 159 holds the balls 157 between the adjacent cylindrical elements 159*a* such that the balls 157 are prevented from moving in the circumferential direction. The balls 157 held by the ball holding member 159 face a rear end surface 117*e* of the spindle 117. A biasing member in the form of a compression coil spring 158 for releasing frictional contact is disposed within the spring receiving hole 117*d* of the spindle 117. One end of the compression coil spring 158 is held in contact with a bottom of the spring receiving hole 117*d* and the other end is held in contact with a front end surface of a needle pin 154 which is fitted in the spring receiving hole 117*d* and can slide in the longitudinal direction. The rear end surface of the needle pin 154 is held in contact with the front end surface of the fixed hub 153 and the biasing force of the compression coil spring 158 acting on the needle pin 154 is received by the front end surface of the fixed hub 153. Thus, the spindle 117 is constantly biased forward. In this state, the balls 157 are separated from the rear end surface 117*e* of the spindle 117 and not pressed against the tapered surface 153*a* of the fixed hub 153 and the inner circumferential surface 155*b* of the driving gear 155.

In the other points, this embodiment has the same construction as the above-described first embodiment. Therefore, components in this embodiment which are substantially identical to those in the first embodiment are given like numerals as in the first embodiment, and they are not described.

The power transmitting mechanism 131 according to this embodiment is constructed as described above. FIG. 8 shows an initial state in which the screw tightening operation is not yet performed (the driver bit 119 is not pressed against the workpiece). In this initial state, the ball holding member 159 is moved forward together with the spindle 117 by the compression coil spring 158, and the balls 157 are not pressed against the tapered surface 153*a* of the fixed hub 153 and the inner circumferential surface 155*b* of the driving gear 155. Specifically, in this state, the torque of the driving gear 155 is not transmitted to the ball holding member 159. This transmission interrupted state is a feature that corresponds to the "power transmission interrupted state" according to the present invention. In this power transmission interrupted state, when the trigger (not shown) is depressed to drive the driving motor, the driving gear 155 is caused to idle, and in the idling state, the spindle 117 is not rotationally driven.

In the idling state, when a screw (not shown) is set on the driver bit 119 and the driver bit 119 is pressed against the workpieee, the driver bit 119, the spindle 117 and the ball holding member 159 are pushed together toward the body 103 while compressing the compression coil spring 158. Then the rear end surface 117*e* of the spindle 117 pushes the balls 157 rearward. Thus, the balls 157 are pushed in between the tapered surface 153*a* of the fixed hub 153 and the inner circumferential surface 155*b* of the driving gear 155 and serve as a wedge. As a result, frictional force is caused on contact surfaces (points) between the tapered surface 153*a* and the balls 157 and between the inner circumferential surface 155*b* and the balls 157, and the balls 157 are caused to roll on the tapered surface 153*a* of the fixed hub 153 in the circumferential direction by receiving the torque of the rotating driving gear 155. Specifically, the balls 157 are caused to revolve while rotating. Therefore, the ball holding member 159, the spindle 117 and the driver bit 119 are caused to rotate in the same direction as the driving gear 155 at reduced speed lower than the revolution speed of the balls 157 or the rotation speed of the driving gear 155, and the screw is driven into the workpiece. This state is shown in FIG. 9. The state in which the torque of the driving gear 155 is transmitted to the ball holding member 159 via the balls 157 is a feature that corresponds to the "operating state" according to the present invention. Further, in the screw tightening operation, like in the above-described first embodiment, the screw penetration depth is regulated by contact of the locator 123 with the workpiece, and transmission of rotation from the driving gear 155 to the driven-side member in the form of the ball holding member 159 is interrupted upon further screw driving after contact of the locator 123 with the workpiece.

According to this embodiment, the balls 157 are pushed in between the tapered surface 153*a* of the fixed hub 153 and the inner circumferential surface 155*b* of the driving gear 155, so that the frictional force is caused therebetween and causes the balls 157 to rotate and revolve. As a result, the torque of the driving-side member in the form of the driving gear 155 is transmitted to the driven-side member in the form of the ball holding member 159 and the spindle 117. With such a construction, this embodiment has substantially the same effects as the above-described first embodiment. For example, the pushing force of the spindle 117 in the longitudinal direction is amplified to a force in a radial direction transverse to the longitudinal direction by the wedging effect, so that higher frictional force can be obtained and the power transmitting performance can be enhanced. Further, in this embodiment, it may also be constructed such that the inner circumferential surface 155*b* of the driving gear 155 is configured as a tapered surface and the tapered surface 153*a* of the fixed hub 153 is configured as a parallel surface, or such that both the inner circumferential surface 155*b* of the driving gear 155 and the outer circumferential surface of the fixed hub 153 are configured as a tapered surface.

(Third Embodiment of the Invention)

Figure 11:
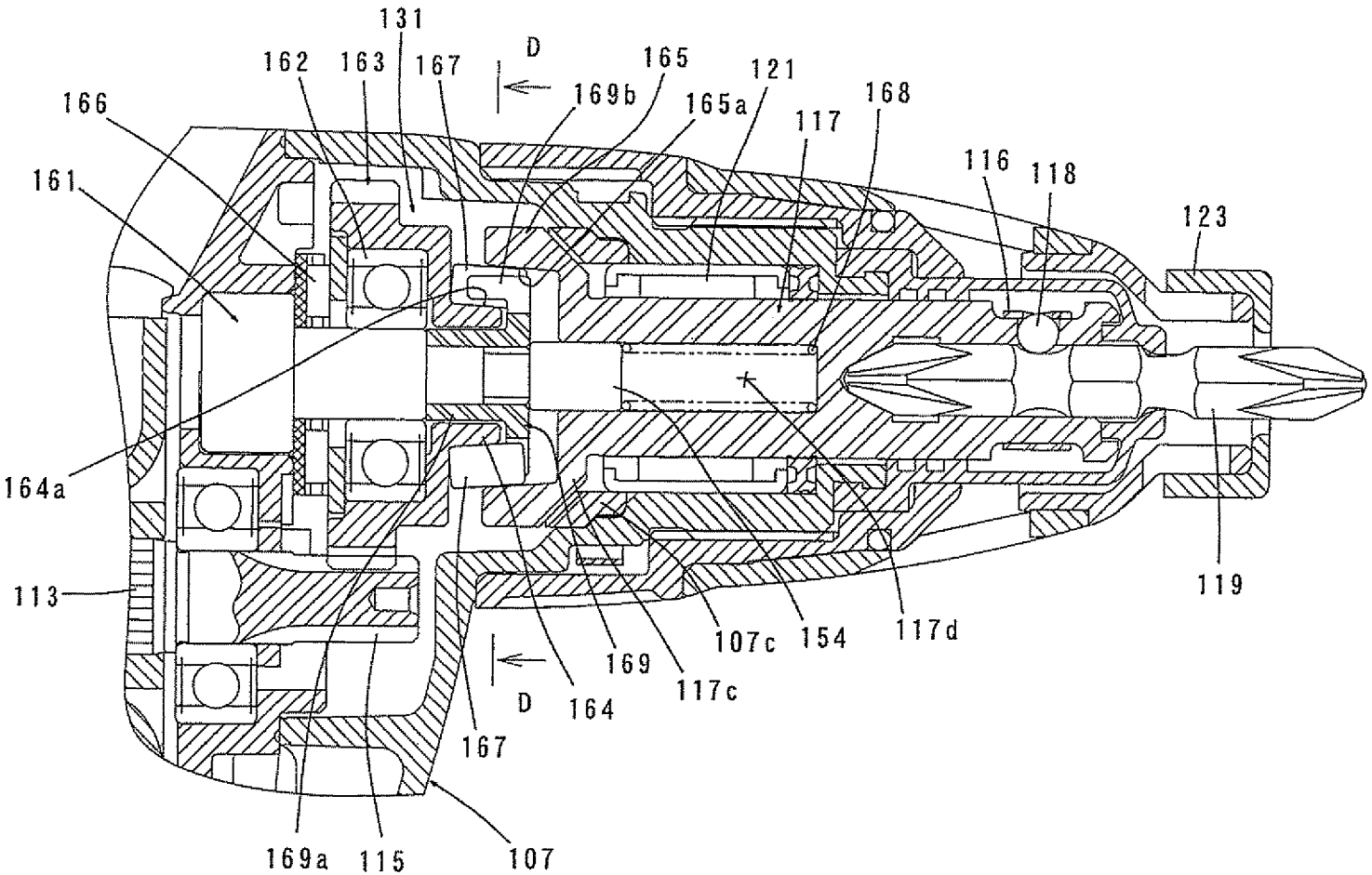
FIG. 11 is a sectional view showing a power transmitting mechanism of a screwdriver according to a third embodiment of the present invention, in an initial state in which power transmission is interrupted.
Figure 12:
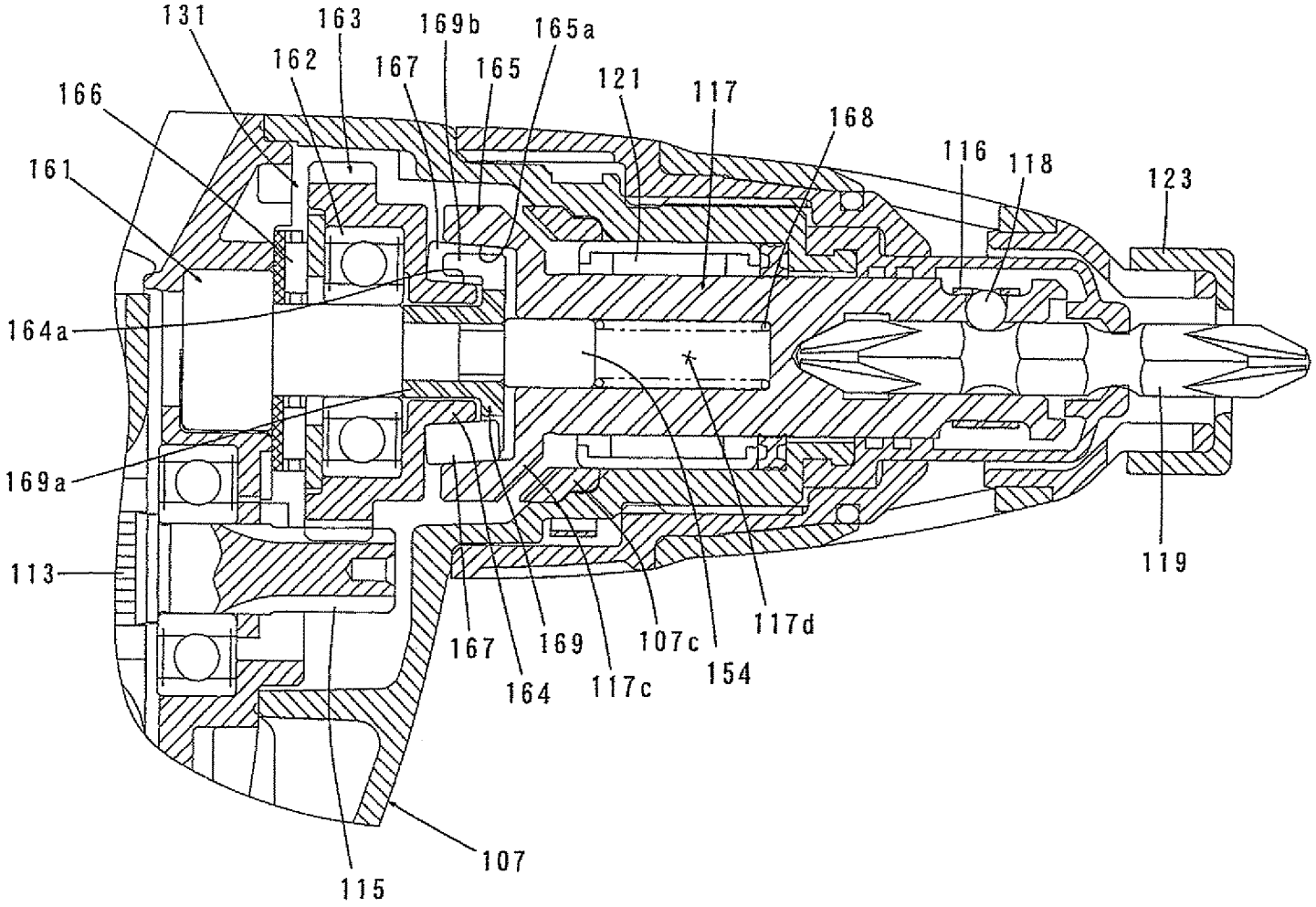
FIG. 12 is also a sectional view showing the power transmitting mechanism in a power transmission state.
Figure 13:
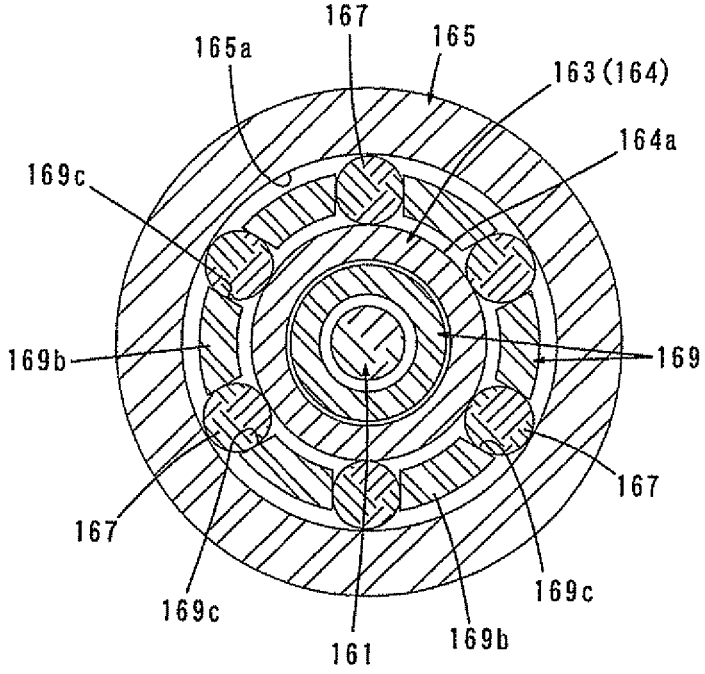
FIG. 13 is a sectional view taken along line D-D in FIG. 11.

A third embodiment of the present invention is now described with reference to FIGS. 11 to 13. This embodiment relates to a modification of the power transmitting mechanism 131 of the screwdriver 101 and mainly includes a radial friction clutch of a non-revolving planetary roller type. As shown in FIGS. 11 and 12, the power transmitting mechanism 131 mainly includes a fixed hub 161, a driving gear 163 which corresponds to the sun member of the planetary gear speed reducing mechanism, a driven-side cylindrical portion 165 which is integrally formed on the rear end of the spindle 117 and corresponds to the outer ring member of the planetary gear speed reducing mechanism, a plurality of columnar rollers 167 which are disposed between the driving gear 163 and the driven-side cylindrical portion 165 and correspond to the planetary member of the planetary gear speed reducing mechanism, and a fixed roller holding member 169 which serves to hold the rollers 167 and corresponds to the carrier of the planetary gear speed reducing mechanism. The driving gear 163, the driven-side cylindrical portion 165 and the rollers 167 are features that correspond to the "driving-side member", the "driven-side member" and the "intervening member", respectively, according to the present invention.

A rear end portion of the fixed hub 161 in the longitudinal direction of the spindle 117 is fixed to the gear housing 107 rearward of the spindle 117, and the fixed hub 161 supports the driving gear 163 via a bearing 162 such that the driving gear 163 can rotate. The driving gear 163 is constantly engaged with the pinion gear 115 of the motor shaft 113 and has a cylindrical portion 164 protruding a predetermined distance forward on its front, and a tapered surface 164*a* is formed on an outer circumferential surface of the cylindrical portion 164. Further, a rear surface of the driving gear 163 is supported by the gear housing 107 via a thrust bearing 166, so that the thrust bearing 166 can receive the pushing force in the screw tightening operation.

The driven-side cylindrical portion 165 formed integrally with the spindle 117 is disposed over the cylindrical portion 164 of the driving gear 163, and has an inner circumferential surface formed by a tapered surface 165*a*. The tapered surface 164*a* of the driving gear 163 and the tapered surface 165*a* of the driven-side cylindrical portion 165 are features that correspond to the "tapered portion" according to the present invention. The tapered surface 164*a* of the driving gear 163 is tapered forward (toward the driver bit), and the tapered surface 165*a* of the driven-side cylindrical portion 165 is also tapered forward. Further, the inclination angle of the tapered surfaces 164*a*, 165*a* with respect to the longitudinal direction of the spindle 117 is set similarly to that of the above-described first embodiment.

The driving gear 163 and the driven-side cylindrical portion 165 are coaxially disposed. The tapered surface 164*a* of the driving gear 163 and the tapered surface 165*a* of the driven-side cylindrical portion 165 are opposed to each other with a predetermined space in the radial direction transverse to the longitudinal direction of the spindle 117, and within this space, the rollers 167 are disposed in the circumferential direction. The roller holding member 169 for holding the rollers 167 is a generally cylindrical member disposed between the driving gear 163 and the spindle 117, and a boss part 169*a* of the roller holding member 169 is fixed to the front end of the fixed hub 161. In the roller holding member 169, a barrel part 169*b* forming a circumferential wall surface is disposed between the tapered surface 164*a* of the driving gear 163 and the tapered surface 165*a* of the driven-side cylindrical portion 165, and the rollers 167 are rotatably held by the barrel part 169*b*. Specifically, as shown in FIG. 13, a plurality of axially extending roller installation grooves 169*c* are formed in the barrel part 169*b* of the roller holding member 169 and spaced at predetermined (equal) intervals in the circumferential direction. The rollers 167 are loosely fitted in the roller installation grooves 169*c*. The rollers 167 are held by the roller holding member 169 such that the rollers are allowed to rotate within the roller installation grooves 169*c* and move in the radial direction of the roller holding member 169, but the rollers are prevented from moving in the circumferential direction with respect to the roller holding member 169.

As shown in FIGS. 11 and 12, a longitudinally extending spring receiving hole 117*d* is formed in the center of the rear portion of the spindle 117 and the biasing member in the form of a compression coil spring 168 which serves to release frictional contact is disposed in the spring receiving hole 117*d*. One end of the compression coil spring 168 is held in contact with a bottom of the spring receiving hole 117*d* and the other end is held in contact with a front end surface of a needle pin 154 which is fitted in the spring receiving hole 117*d* and can slide in the longitudinal direction. A rear end surface of the needle pin 154 is held in contact with the front end surface of the fixed hub 161 and the biasing force of the compression coil spring 168 acting on the needle pin 154 is received by the front end surface of the fixed hub 161. Thus, the spindle 117 is constantly biased forward. In this state, the distance between the tapered surface 164*a* of the driving gear 163 and the tapered surface 165*a* of the driven-side cylindrical portion 165 is increased in the radial direction. Therefore, the rollers 167 are not pressed against the tapered surfaces 164*a*, 165*a* and frictional force is not caused.

In the other points, this embodiment has the same construction as the above-described first embodiment. Therefore, components in this embodiment which are substantially identical to those in the first embodiment are given like numerals as in the first embodiment, and they are not described.

The power transmitting mechanism 131 according to this embodiment is constructed as described above. FIG. 11 shows an initial state in which the screw tightening operation is not yet performed (the driver bit 119 is not pressed against the workpiece). In this initial state, the driven-side cylindrical portion 165 is moved forward together with the spindle 117 by the compression coil spring 168 and the rollers 167 are not pressed against the tapered surfaces 164*a*, 165*a*. In this state, the torque of the driving gear 163 is not transmitted to the driven-side cylindrical portion 165. This transmission interrupted state is a feature that corresponds to the "power transmission interrupted state" according to the present invention. In this power transmission interrupted state, when the trigger (not shown) is depressed to drive the driving motor, the driving gear 163 is caused to idle, and in the idling state, the spindle 117 is not rotationally driven.

In this idling state, when a screw (not shown) is set on the driver bit 119 and the driver bit 119 is pressed against the workpiece, the driver bit 119, the spindle 117 and the driven-side cylindrical portion 165 are pushed together toward the body 103 while compressing the compression coil spring 168. By this movement, the distance between the tapered surface 165*a* of the driven-side cylindrical portion 165 and the tapered surface 164*a* of the driving gear 163 is decreased in the radial direction, and the rollers 167 are pushed in between the tapered surfaces 164*a* and 165*a* and serve as a wedge. As a result, frictional force is caused on contact surfaces (lines) between the tapered surfaces 164*a*, 165*a* and the rollers 167, and the rollers 167 are caused to rotate on the tapered surface 164*a* of the rotating driving gear 163, and thus the driven-side cylindrical portion 165 is caused to rotate. Specifically, the driven-side cylindrical portion 165, the spindle 117 and the driver bit 119 are caused to rotate in an opposite direction from the driving gear 163 at reduced speed lower than the rotation speed of the driving gear 163, and the screw is driven into the workpiece. This state is shown in FIG. 12. The state in which the torque of the driving gear 163 is transmitted to the driven-side cylindrical portion 165 via the rollers 167 is a feature that corresponds to the "operating state" according to the present invention. Further, in the screw tightening operation, like in the above-described first embodiment, the screw penetration depth is regulated by contact of the locator 123 with the workpiece, and transmission of rotation from the driving gear 163 to the driven-side cylindrical portion 165 is interrupted upon further screw driving after contact of the locator 123 with the workpiece.

According to this embodiment, the rollers 167 are pushed in between the tapered surface 164*a* of the driving gear 163 and the tapered surface 165*a* of the driven-side cylindrical portion 165, so that the frictional force is caused therebetween and the torque of the driving gear 163 is transmitted to the driven-side cylindrical portion 165 and the spindle 117. With such a construction, this embodiment has substantially the same effects as the above-described first embodiment. For example, the pushing force of the spindle 117 in the longitudinal direction is amplified to a force in a radial direction transverse to the longitudinal direction by the wedging effect, so that higher frictional force can be obtained and the power transmitting performance can be enhanced.

(Fourth Embodiment of the Invention)

Figure 14:
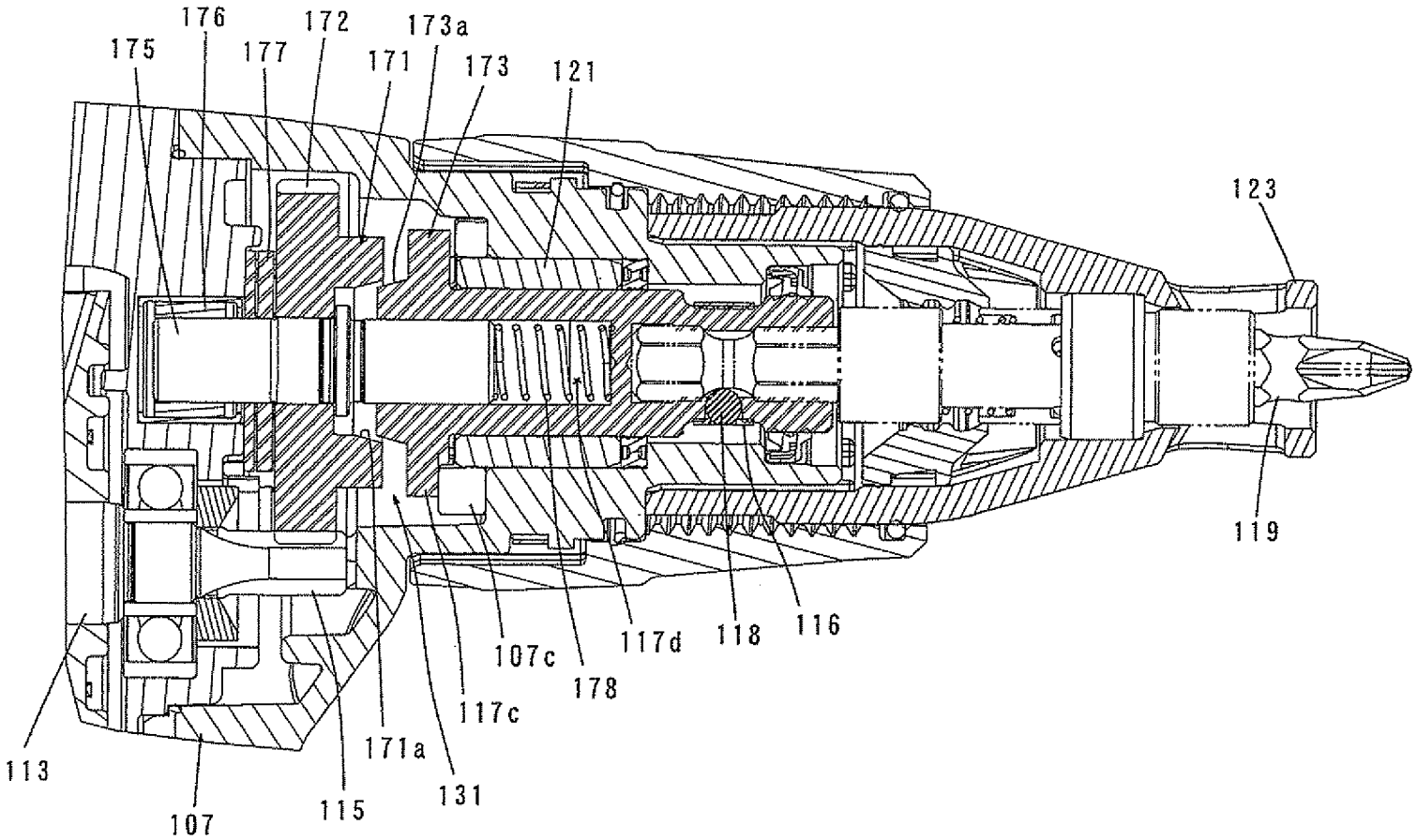
FIG. 14 is a sectional view showing a power transmitting mechanism of a screwdriver according to a fourth embodiment of the present invention, in an initial state in which power transmission is interrupted.
Figure 15:
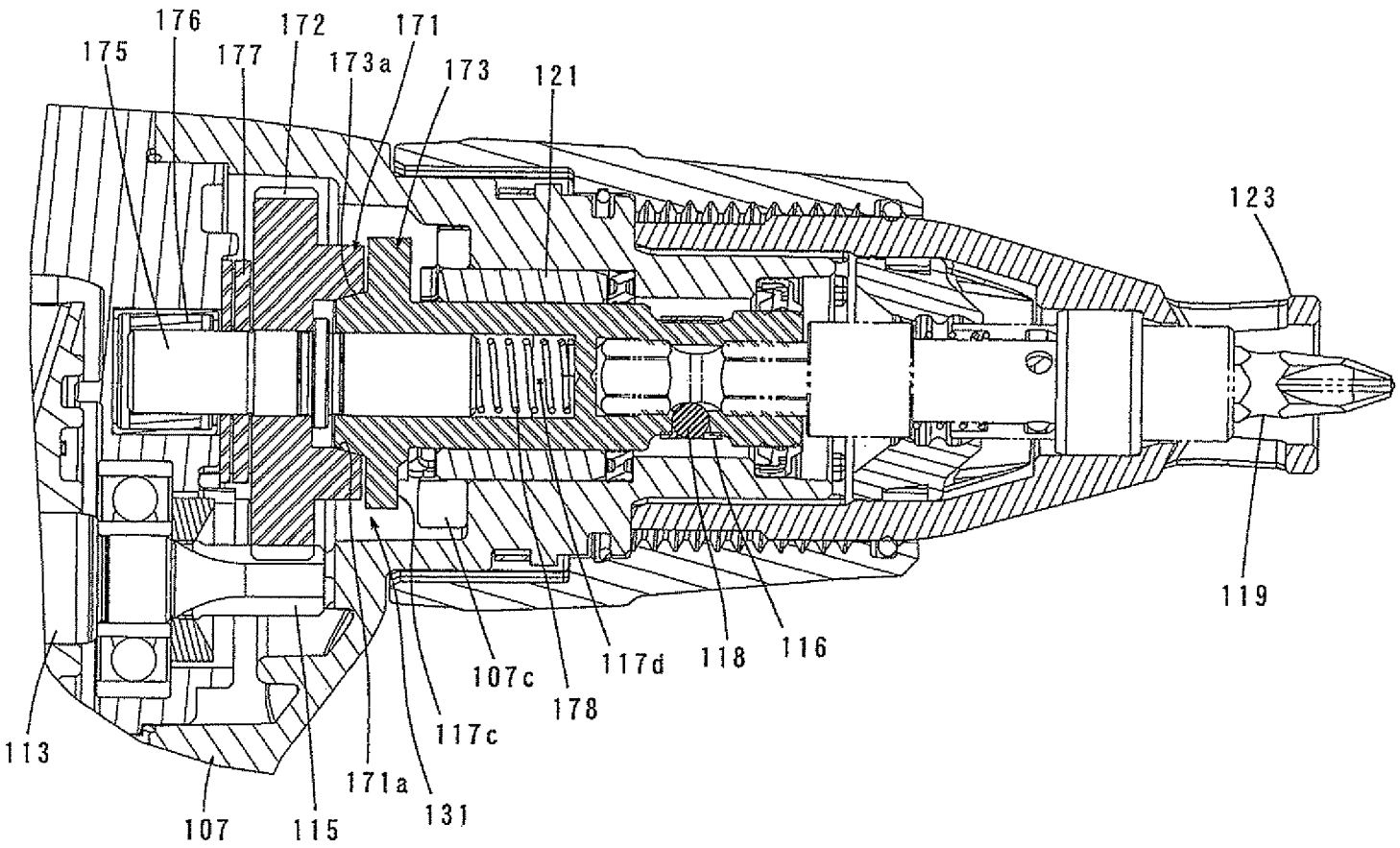
FIG. 15 is also a sectional view showing the power transmitting mechanism in a power transmission state.

A fourth embodiment of the present invention is now described with reference to FIGS. 14 and 15. This embodiment relates to a modification of the power transmitting mechanism 131 of the screwdriver 101 and mainly includes a radial friction clutch of a tapered surface type. As shown in FIGS. 14 and 15, the power transmitting mechanism 131 mainly includes a disc-like driving-side clutch 171 which is disposed at the rear of the spindle 117 and has teeth 172 constantly engaged with the pinion gear 115 of the motor shaft 113, and a driven-side clutch 173 which is integrally formed on the rear end portion of the spindle 117. The driving-side clutch 171 and the driven-side clutch 173 are features that correspond to the "driving-side member" and the "driven-side member", respectively, according to the present invention.

The driving-side clutch 171 and the driven-side clutch 173 are opposed to each other on the axis of the spindle 117. On the opposed surfaces, the driving-side clutch 171 has a concave tapered surface (conical surface) 171*a* and the driven-side clutch 173 has a convex tapered surface (conical surface) 173*a*. The tapered surfaces 171*a*, 173*a* are features that correspond to the "tapered portion" according to the present invention. Further, the inclination angle of the tapered surfaces 171*a*, 173*a* with respect to the longitudinal direction of the spindle 117 is set similarly to that of the above-described first embodiment. The concave shape and the convex shape of the tapered surfaces 171*a*, 173*a* may be provided vice versa.

The driving-side clutch 171 is fixedly fitted onto a clutch shaft 175. One end (rear end) of the clutch shaft 175 in the longitudinal direction of the spindle 117 is rotatably supported by the gear housing 107 via a bearing 176 and the other end (front end) is fitted in the spring receiving hole 117*d* formed in the rear portion of the spindle 117 such that it can rotate and move in the longitudinal direction with respect to the spring receiving hole 117*d*. The spindle 117 is supported by a bearing 121. Therefore, the spindle 117 and the clutch shaft 175 are supported at two front and rear points in the longitudinal direction of the spindle 117 by the bearings 121, 176, so that stable rotation can be realized.

Further, a thrust bearing 177 is disposed on a rear surface of the driving-side clutch 171 (facing away from the tapered surface 171*a*) and serves to receive the pushing force in the screw tightening operation. The biasing member in the form of a compression coil spring 178 which serves to release frictional contact is disposed in the spring receiving hole 117*d* of the spindle 117, and the spindle 117 is constantly biased forward by the compression coil spring 178. One end of the compression coil spring 178 is held in contact with a bottom of the spring receiving hole 117*d* and the other end is held in contact with a front end surface of the clutch shaft 175. Therefore, the driven-side clutch 173 integrally formed with the spindle 117 is placed in an initial position (power transmission interrupted position) in which the tapered surface 173*a* of the driven-side clutch 173 is separated from the tapered surface 171*a* of the driving-side clutch 171. This state is shown in FIG. 14.

In the other points, this embodiment has the same construction as the above-described first embodiment. Therefore, components in this embodiment which are substantially identical to those in the first embodiment are given like numerals as in the first embodiment, and they are not described.

The power transmitting mechanism 131 according to this embodiment is constructed as described above. In an initial state (see FIG. 14) in which the screw tightening operation is not yet performed (the driver bit 119 is not pressed against the workpiece), the driven-side clutch 173 is moved forward together with the spindle 117 by the compression coil spring 178 and thus separated from the driving-side clutch 171. In this state, the torque of the driving gear 172 is not transmitted to the driven-side clutch 173. This transmission interrupted state is a feature that corresponds to the "power transmission interrupted state" according to the present invention. In the power transmission interrupted state, when the trigger (not shown) is depressed to drive the driving motor, the driving-side clutch 171 is caused to idle, and in the idling state, the spindle 117 is not rotationally driven.

In this idling state, when a screw (not shown) is set on the driver bit 119 and the driver bit 119 is pressed against the workpiece, as shown in FIG. 15, the driver bit 119, the spindle 117 and the driven-side clutch 173 are pushed together toward the body 103 while compressing the compression coil spring 178, and the tapered surface 173*a* of the driven-side clutch 173 is directly pressed against the tapered surface 171*a* of the driving-side clutch 171. As a result, frictional force is caused on the both tapered surfaces 171*a*, 173*a* by the wedge action, so that rotation of the driving-side clutch 171 is transmitted to the driven-side clutch 173, the spindle 117 and the driver bit 119 and the screw tightening operation can be performed. The state in which the torque of the driving-side clutch 171 is transmitted to the driven-side clutch 173 is a feature that corresponds to the "operating state" according to the present invention. Further, in the screw tightening operation, like in the above-described embodiments, the screw penetration depth is regulated by contact of the locator 123 with the workpiece, and transmission of rotation from the driving-side clutch 171 to the driven-side clutch 173 is interrupted upon further screw driving after contact of the locator 123 with the workpiece.

According to this embodiment, the torque is transmitted by the frictional force between the tapered surface 171*a* of the driving-side clutch 171 and the tapered surface 173*a* of the driven-side clutch 173. With such a construction, the pushing force in the longitudinal direction of the spindle 117 is amplified to a force in a radial direction transverse to the longitudinal direction of the spindle 117 by the wedging effect, so that higher frictional force can be obtained and the power transmitting performance can be enhanced. Further, noise and wear which may be caused in the case of a conventional claw clutch in which claws hit each other upon clutch engagement can be avoided, so that durability can be improved. Moreover, increase of the length in the longitudinal direction, which may be caused in the case of a multiplate friction clutch in which a number of friction plates are layered in the longitudinal direction, can be avoided, and the screwdriver 101 can be provided in which the length of the body 103 in the longitudinal direction is decreased.

(Fifth Embodiment of the Invention)

Figure 16:
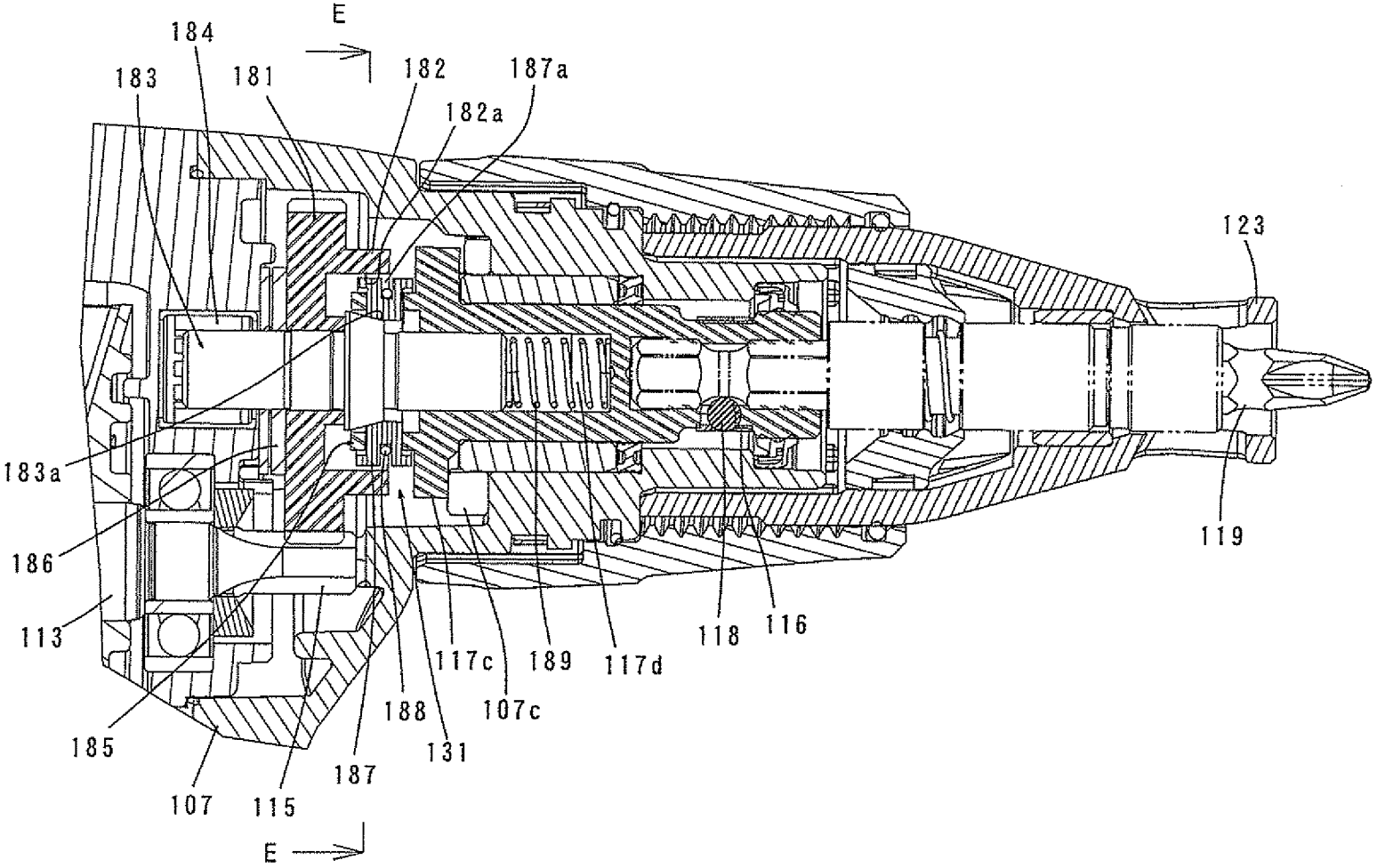
FIG. 16 is a sectional view showing a power transmitting mechanism of a screwdriver according to a fifth embodiment of the present invention, in an initial state in which power transmission is interrupted.
Figure 17:
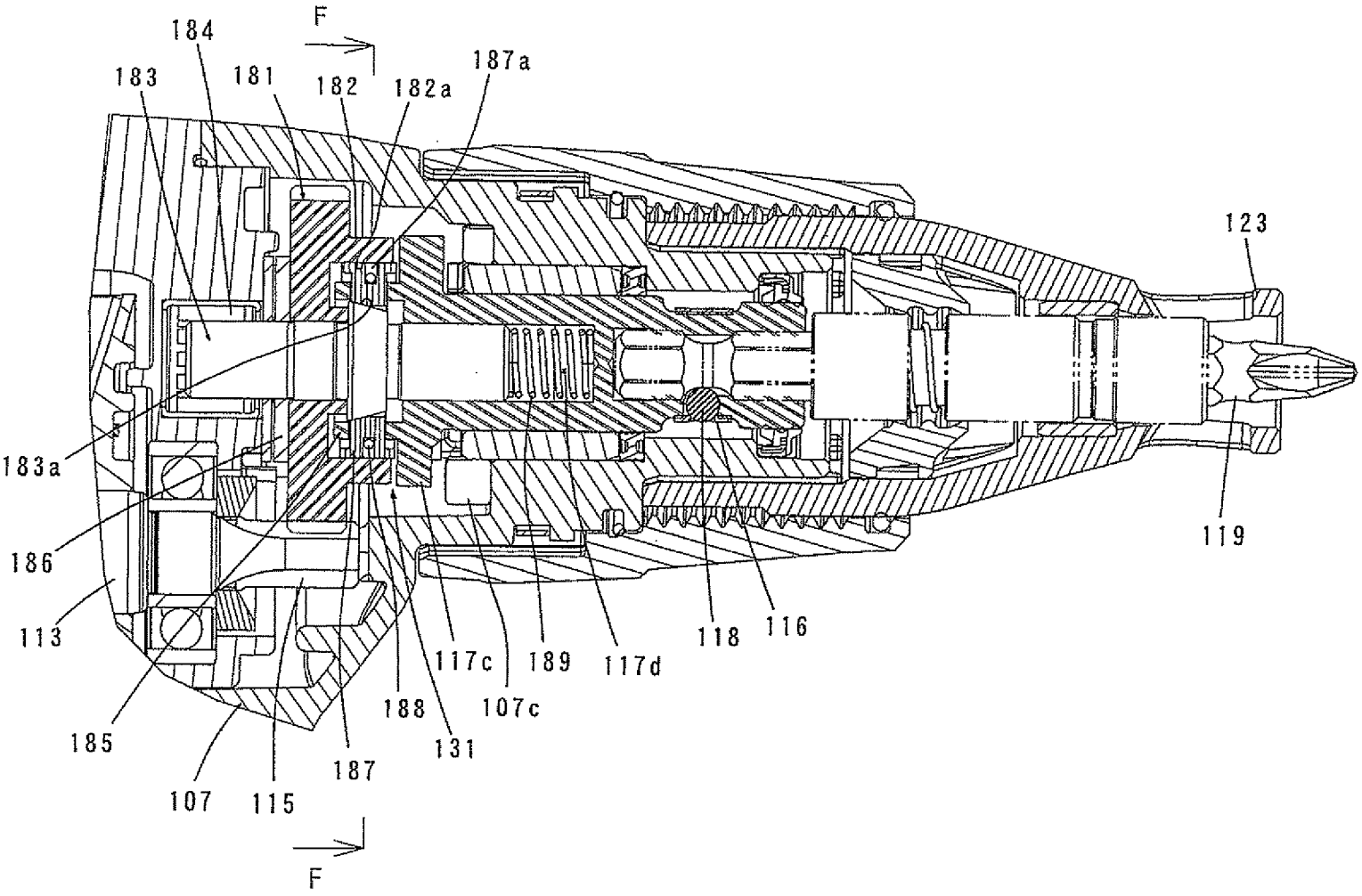
FIG. 17 is also a sectional view showing the power transmitting mechanism in a power transmission state.

A fifth embodiment of the present invention is now described with reference to FIGS. 16 to 19. This embodiment relates to a modification of the power transmitting mechanism 131 of the screwdriver 101 and mainly includes a radial friction clutch of a drum brake type. As shown in FIGS. 16 and 17, the power transmitting mechanism 131 mainly includes a disc-like driving gear 181 which is disposed at the rear of the spindle 117, a gear shaft 183 onto which the driving gear 181 is mounted, a cylindrical driven-side barrel part 185 which is integrally formed on the rear end of the spindle 117, and a brake shoe 187 which is disposed between the driving gear 181 and the driven-side barrel part 185. The driving gear 181 and the gear shaft 183 are features that correspond to the "driving-side member" according to the present invention. The driven-side barrel part 185 and the brake shoe 187 are features that correspond to the "driven-side member" and the "intervening member", respectively, according to the present invention. The driving gear 181, the gear shaft 183 and the driven-side barrel part 185 (the spindle 117) are coaxially disposed.

One axial end (rear end) of the gear shaft 183 is rotatably supported by the gear housing 107 via a bearing 184 and the other end (front end) is fitted in a rear end portion of the spring receiving hole 117*d* of the spindle 117 such that it can rotate and move in the longitudinal direction of the spindle 117. A cylindrical portion 182 is integrally formed on the front end of the driving gear 181 and extends a predetermined distance forward therefrom, and an inner circumferential surface 182*a* of the cylindrical portion 182 is parallel to the longitudinal direction of the spindle 117. A tapered surface 183*a* having a larger diameter than the gear shaft 183 is formed in a region of the gear shaft 183 which faces the cylindrical portion 182 of the driving gear 181. This tapered surface 183*a* is tapered forward (toward the driver bit) and is a feature that corresponds to the "tapered portion" according to the present invention. Further, the inclination angle of the tapered surface 183*a* with respect to the longitudinal direction of the spindle 117 is set similarly to that of the above-described first embodiment.

Figure 18:
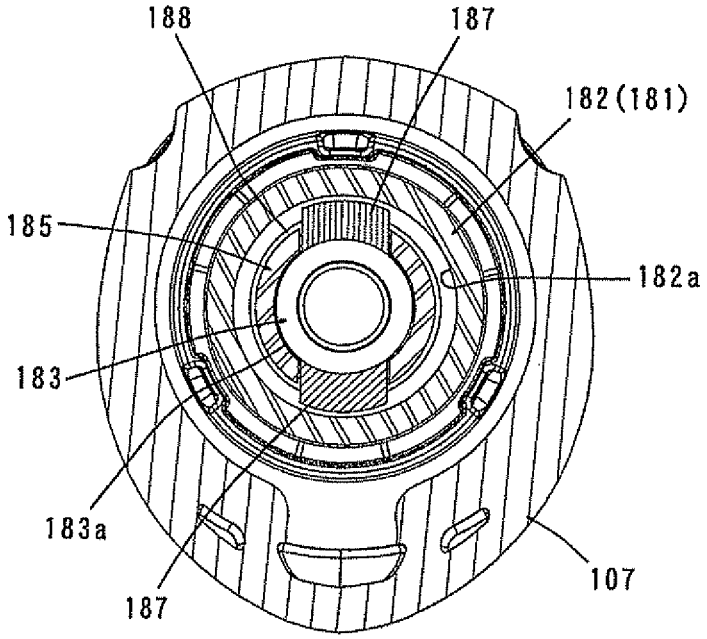
FIG. 18 is a sectional view taken along line E-E in FIG. 16.
Figure 19:
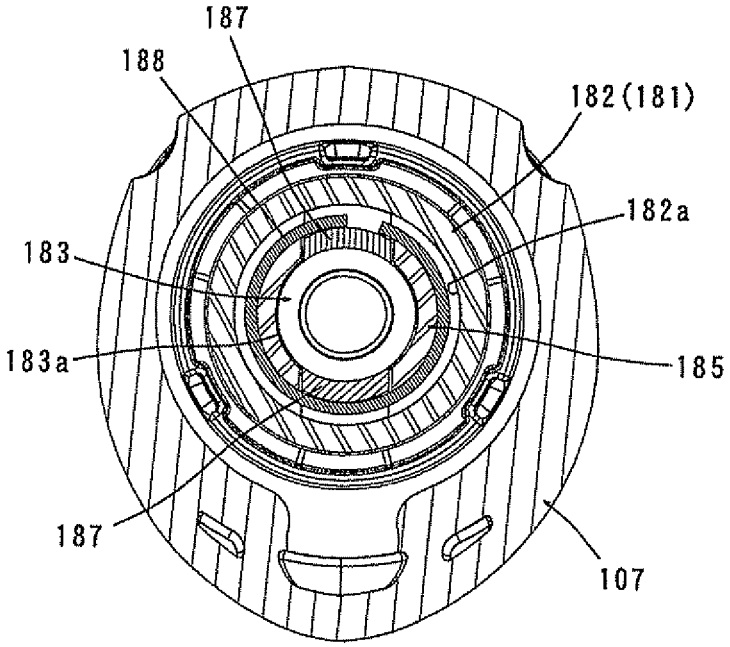
FIG. 19 is a sectional view taken along line F-F in FIG. 17.

The inner circumferential surface 182*a* of the cylindrical portion 182 and the tapered surface 183*a* of the gear shaft 183 are opposed to each other with a predetermined space in the radial direction transverse to the longitudinal direction of the spindle 117 and the driven-side barrel part 185 is disposed in this space. As shown in FIGS. 18 and 19, two brake shoes 187 are mounted on the driven-side barrel part 185 and diametrically opposed to each other on opposite sides of the rotation axis of the driven-side barrel part 185. The brake shoe 187 has a generally rectangular block-like shape. An inner surface of the brake shoe 187 which faces the tapered surface 183*a* of the gear shaft 183 is configured as an arcuate curved surface conforming to the tapered surface 183*a* of the gear shaft 183, and an outer surface of the brake shoe 187 which faces the inner circumferential surface 182*a* of the cylindrical portion 182 is configured as an arcuate curved surface conforming to the inner circumferential surface 182*a*. The brake shoes 187 are mounted on the driven-side barrel part 185 and can move in the radial direction transverse to the longitudinal direction of the spindle 117 with respect to the driven-side barrel, and constantly biased inward (toward the center of the axis) by a ring spring 188. The ring spring 188 is shaped in an annular form having a cut at one point in the circumferential direction and is fitted in an annular recess 187*a* formed in the outer surface of the driven-side barrel part 185 and the center of the outer surface of the brake shoe 187. The ring spring 188 elastically biases the brake shoes 187 in the radial direction while preventing the brake shoes 187 from moving in the longitudinal direction, so that stable movement of the brake shoes 187 can be realized.

Further, a thrust bearing 186 is disposed between a rear surface of the driving gear 181 and an inner wall surface of the gear housing 107 in a direction transverse to the longitudinal direction of the spindle 117 and serves to receive the pushing force in the screw tightening operation. The biasing member in the form of a compression coil spring 189 for releasing frictional contact is disposed within the spring receiving hole 117*d* of the spindle 117, and the spindle 117 is constantly biased forward by the compression coil spring 189. One end of the compression coil spring 189 is held in contact with the bottom of the spring receiving hole 117*d* and the other end is held in contact with the front end surface of the gear shaft 183. Therefore, the brake shoes 187 which are held by the driven-side barrel part 185 integrally formed with the spindle 117 are moved toward the front end of the tapered surface 183*a* and placed in an initial position (power transmission interrupted position) in which the brake shoes 187 are separated from the inner circumferential surface 182*a* of the cylindrical portion 182 of the driving gear 181. This state is shown in FIG. 16. In the other points, this embodiment has the same construction as the above-described first embodiment. Therefore, components in this embodiment which are substantially identical to those in the first embodiment are given like numerals as in the first embodiment, and they are not described.

The power transmitting mechanism 131 according to this embodiment is constructed as described above. FIG. 16 shows an initial state in which the screw tightening operation is not yet performed (the driver bit 119 is not pressed against the workpiece). In this initial state, the driven-side barrel part 185 is moved forward together with the spindle 117 by the compression coil spring 189 and the brake shoes 187 are not pressed against the inner circumferential surface 182*a* of the cylindrical portion 182 of the driving gear 181. In this state, the torque of the driving gear 181 is not transmitted to the driven-side barrel part 185. This transmission interrupted state is a feature that corresponds to the "power transmission interrupted state" according to the present invention. In this power transmission interrupted state, when the trigger (not shown) is depressed to drive the driving motor, the driving gear 181 is caused to idle, and in the idling state, the spindle 117 is not rotationally driven.

In this idling state, when a screw (not shown) is set on the driver bit 119 and the driver bit 119 is pressed against the workpiece, the driver bit 119, the spindle 117 and the driven-side barrel part 185 are pushed together toward the body 103 while compressing the compression coil spring 189, and the brake shoes 187 held by the driven-side barrel part 185 are moved rearward along the tapered surface 183*a* of the gear shaft 183. As shown in FIG. 17, the brake shoes 187 moved rearward are pushed radially outward by the tapered surface 183*a* and pressed against the inner circumferential surface 182*a* of the cylindrical portion 182 of the driving gear 181, so that the brake shoes 187 serve as a wedge. As a result, frictional force is caused between the brake shoes 187 and the tapered surface 183*a*, and between the brake shoes 187 and the inner circumferential surface 182*a*. As a result, the torque of the driving gear 181 is transmitted to the driven-side barrel part 185, the spindle 117 and the driver bit 119 via the brake shoes 187 and the screw tightening operation can be performed. The state in which the torque of the driving gear 181 is transmitted to the driven-side barrel part 185 is a feature that corresponds to the "operating state" according to the present invention. Further, in the screw tightening operation, like in the above-described embodiments, the screw penetration depth is regulated by contact of the locator 123 with the workpiece, and transmission of rotation from the driving gear 181 to the driven-side barrel part 185 is interrupted upon further screw driving after contact of the locator 123 with the workpiece.

According to this embodiment, the brake shoes 187 held by the driven-side barrel part 185 are disposed between the inner circumferential surface 182*a* of the cylindrical portion 182 of the driving gear 181 and the tapered surface 183*a* of the gear shaft 183 and pressed against them, so that the frictional force is caused therebetween and the torque of the driving gear 181 is transmitted to the driven-side barrel part 185. With such a construction, the pushing force of the spindle 117 in the longitudinal direction is amplified to a force in the radial direction of the spindle 117 by the wedging effect, so that higher frictional force can be obtained and the power transmitting performance can be enhanced. Further, noise and wear which may be caused in the case of a conventional claw clutch in which claws hit each other upon clutch engagement can be avoided, so that durability can be improved. Moreover, increase of the length in the longitudinal direction, which may be caused in the case of a multiplate friction clutch in which a number of friction plates are layered in the longitudinal direction, can be avoided, and the screwdriver 101 can be provided in which the length of the body 103 in the longitudinal direction is decreased.

(Sixth Embodiment of the Invention)

Figure 20:
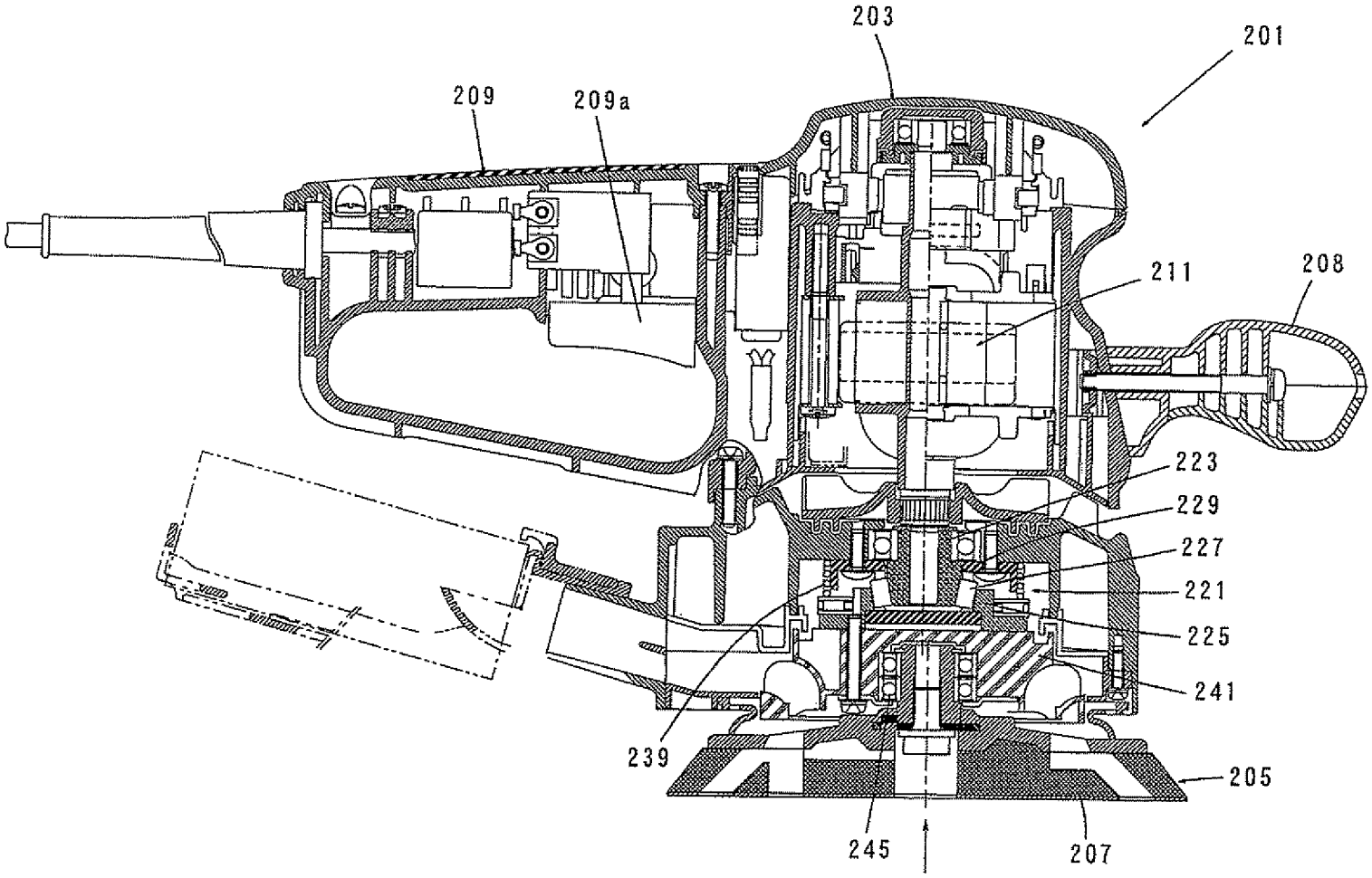
FIG. 20 is a sectional view showing a power transmitting mechanism of an electric sander according to a sixth embodiment of the present invention, in an initial state in which power transmission is interrupted.
Figure 21:
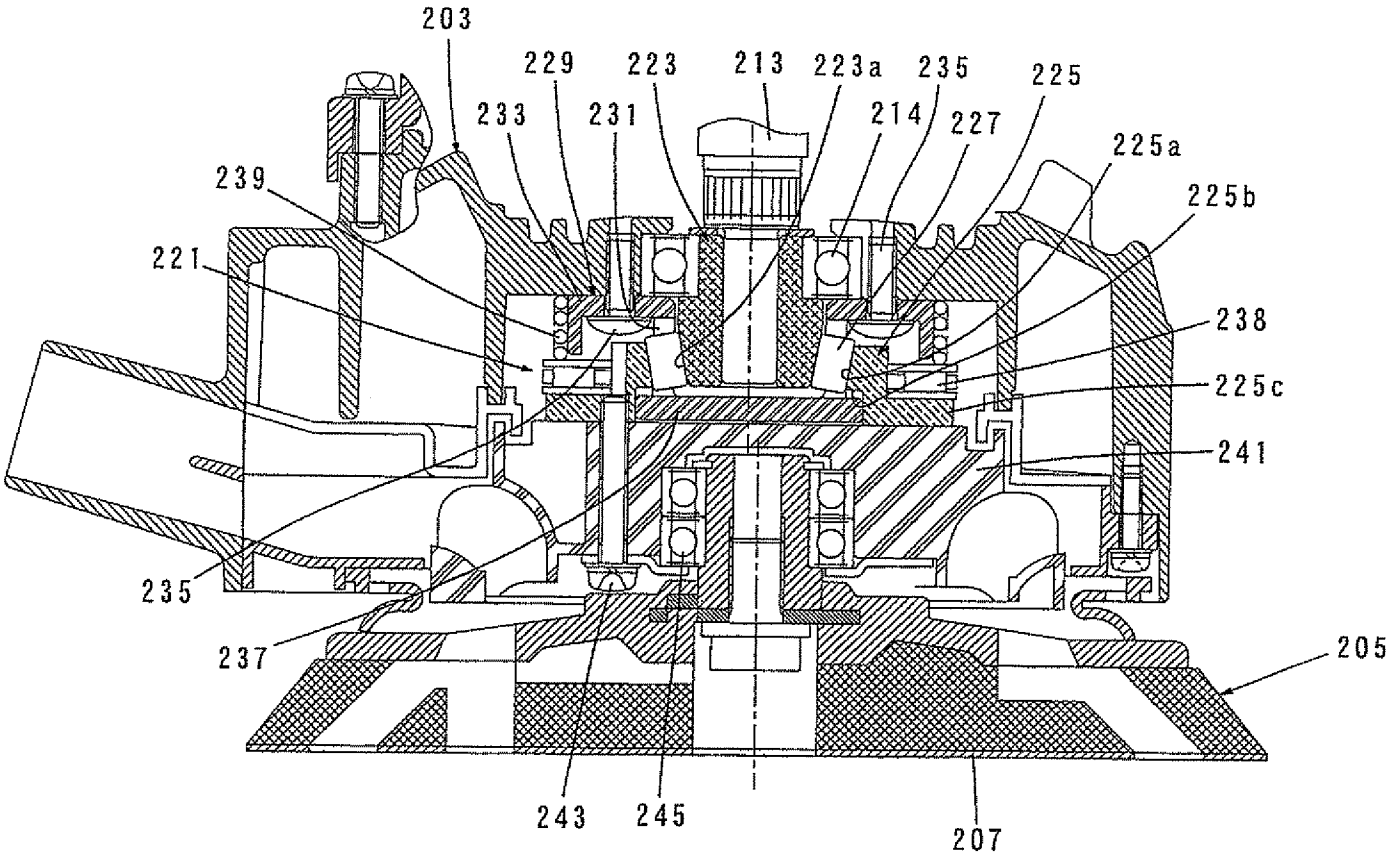
FIG. 21 is an enlarged sectional view showing the power transmitting mechanism of the electric sander in a power transmission state.

A sixth embodiment of the present invention is now described with reference to FIGS. 20 and 21. This embodiment is explained as being applied to an abrasive tool in the form of an electric sander 201 for performing an abrasive operation on a workpiece. As shown in FIG. 20, the electric sander 201 mainly includes a power tool body in the form of a body 203 that is formed by a generally cylindrical housing for housing a driving motor 211 and a power transmitting mechanism 221, and an abrasive part 205 which is disposed on a lower end of the body 203 and protrudes downward therefrom. The body 203 has a handgrip 209 and an auxiliary grip 208 which are held by a user. Further, the driving motor 211 is driven when a trigger 209*a* on the handgrip 209 is depressed by the user. The driving motor 211 is a feature that corresponds to the "prime mover" according to the present invention.

An abrasive in the form of a coated abrasive (sandpaper) 207 or the like is removably attached onto the bottom surface of the abrasive part 205 disposed underneath the body 203 and forms an abrasive surface. The coated abrasive 207 is a feature that corresponds to the "tool bit" according to the present invention. The abrasive part 205 is attached to a crank plate 241 forming a final output shaft of the power transmitting mechanism 221, at a position displaced from a center of a rotation axis of the crank plate 241 via a bearing 245 such that it can rotate in a horizontal plane. The abrasive part 205 is driven by the driving motor 211 via the power transmitting mechanism 221 and is caused to eccentrically rotate. Therefore, in order to perform an abrasive operation on a workpiece with the abrasive surface of the abrasive part 205, the abrasive part 205 is driven with the abrasive surface pressed against the workpiece. Further, the direction of the rotation axis or axial direction of the crank plate 241 is a feature that corresponds to the "axial direction of the tool bit" according to the present invention.

The power transmitting mechanism 221 is now explained. The power transmitting mechanism 221 according to this embodiment mainly includes a radial friction clutch of a non-revolving planetary roller type. As shown in FIG. 21, the power transmitting mechanism 221 mainly includes a driving hub 223 which rotates together with a motor shaft 213 of the driving motor 211 (see FIG. 20), a driven-side annular member 225 which is coaxially disposed with the driving hub 223, a plurality of columnar rollers 227, and a fixed roller holding member 229 which holds the rollers 227. The driving hub 223 corresponds to the sun member of the planetary gear speed reducing mechanism, the driven-side annular member 225 corresponds to the outer ring member of the planetary gear speed reducing mechanism, the rollers 227 correspond to the planetary member of the planetary gear speed reducing mechanism, and the roller holding member 229 corresponds to the carrier of the planetary gear speed reducing mechanism. The driving hub 223, the driven-side annular member 225 and the rollers 227 are features that correspond to the "driving-side member", the "driven-side member" and the "intervening member", respectively, according to the present invention.

The driving hub 223 is supported by the body 203 via the bearing 214 such that it can rotate in the horizontal plane, and has a tapered surface 223*a* on an outer circumferential surface of a lower end portion of the driving hub 223. The driven-side annular member 225 is disposed outside the driving hub 223 and has a tapered surface 225*a* on its inner circumferential surface. The tapered surface 223*a* of the driving hub 223 and the tapered surface 225*a* of the driven-side annular member 225 are features that correspond to the "tapered portion" according to the present invention. The tapered surface 223*a* of the driving hub 223 is tapered downward (toward the abrasive part 205), and the tapered surface 225*a* of the driven-side annular member 225 is also tapered downward. Further, the inclination angle of the tapered surfaces 223*a*, 225*a* with respect to the axial direction of the crank plate 241 is set similarly to that of the above-described first embodiment.

The tapered surface 223*a* of the driving hub 223 and the tapered surface 225*a* of the driven-side annular member 225 are opposed to each other with a predetermined space in the radial direction, and a plurality of rollers 227 are disposed between the tapered surfaces 223*a*, 225*a* in the circumferential direction. The roller holding member 229 for holding the rollers 227 is formed as a generally cylindrical member and has a barrel part (cylindrical portion) 231 and a flange 233 formed on one axial end (upper end) of the barrel part 231 and extending radially outward. Further, the roller holding member 229 is fastened to the body 203 at several points of the flange 233 in the circumferential direction by screws 235. The barrel part 231 of the roller holding member 229 is disposed between the tapered surface 223*a* of the driving hub 223 and the tapered surface 225*a* of the driven-side annular member 225. A plurality of roller installation grooves are formed in the barrel part 231 at predetermined (equal) intervals in the circumferential direction and the rollers 227 are loosely disposed in the roller installation grooves. Further, the structure of holding the rollers 227 by the roller holding member 229 is identical to the roller holding structure of the above-described third embodiment (see FIG. 6). With this construction, the rollers 227 are allowed to rotate within the roller installation grooves and move in the radial direction of the roller holding member 229, but held prevented from moving in the circumferential direction with respect to the roller holding member 229. Specifically, the rollers 227 are rotatably held in a fixed position which is defined by the roller holding member 229 fastened to the body 203.

Each of the rollers 227 is configured as a parallel roller and placed substantially in parallel to the tapered surface 223*a* of the driving hub 223 and the tapered surface 225*a* of the driven-side annular member 225 when disposed between the tapered surfaces 223*a*, 225*a*. Therefore, when the driven-side annular member 225 is moved upward, the distance between the tapered surfaces 223*a*, 225*a* is decreased, so that the rollers 227 are pressed against the tapered surfaces 223*a*, 225*a* and serve as a wedge. Thus, frictional force is caused on contact surfaces between the tapered surfaces 223*a*, 225*a* and the rollers 227, and the rollers 227 are caused to rotate on the tapered surface 223*a* of the rotating driving hub 223, and the torque of the rotating driving hub 223 is transmitted to the driven-side annular member 225. Specifically, the driven-side annular member 225 is caused to rotate at reduced speed in a direction opposite to the direction of rotation of the driving hub 223.

Further, a disc-like suspending member 237 is integrally formed on the lower end of the barrel part 231 of the roller holding member 229 and suspends and supports the driven-side annular member 225. A ring-like engagement surface 225*b* is formed on an inner circumferential surface of the driven-side annular member 225 and extends in the radial direction (horizontal direction) transverse to the axial direction of the crank plate 241. The driven-side annular member 225 is suspended and supported by engagement of the engagement surface 225*b* with an upper surface of an outer edge portion of the suspending member 237, and allowed to move in the axial direction (vertical direction) of the crank plate 241 with respect to the roller holding member 229 (the driving hub 223). Further, an inner surface of the driven-side annular member 225 below the engagement surface 225*b* is slidably fitted onto an outer surface of the suspending member 237. Therefore, the suspending member 237 serves as a guide member for the driven-side annular member 225 to Move in the axial direction (vertical direction) of the crank plate 241.

Further, the driven-side annular member 225 is constantly biased by the biasing member in the form of a compression coil spring 239 in a direction in which its frictional contact with the rollers 227 is released, or in an axial direction of the crank plate 241 (downward direction) in which the distance between the tapered surfaces 223*a*, 225*a* is increased. Therefore, the rollers 227 are held in the initial state (power transmission interrupted state) in which the rollers are separated from either one of the tapered surfaces 223*a*, 225*a*. The driven-side annular member 225 which is moved downward by the compression coil spring 239 is held in the initial position by engagement of the engagement surface 225*b* with the upper surface of the suspending member 237 of the roller holding member 229. This state is shown in FIG. 20. The compression coil spring 239 is disposed between the upper surface of the flange 225*c* formed on the driven-side annular member 225 and a wall surface of the body 203, and held in contact with the upper surface of the flange via a thrust bearing 238. With this construction, the compression coil spring 239 and the driven-side annular member 225 can smoothly rotate with respect to each other.

The crank plate (shaft) 241 for mounting the abrasive part 205 is disposed on the underside of the driven-side annular member 225 and fastened to the driven-side annular member 225 at several points in the circumferential direction by screws 243. The crank plate 241 which is caused to rotate together with the driven-side annular member 225 forms the final output shaft of the power transmitting mechanism 221, and the abrasive part 205 is rotatably attached to the crank plate 241 via the bearing 245 at a position displaced a predetermined distance from the center of rotation of the crank plate 241.

The electric sander 201 according to this embodiment is constructed as described above. An initial state in which an abrasive operation is not yet performed (the abrasive surface of the abrasive part 205 is not pressed against the workpiece) is shown in FIG. 20. In this initial state, the driven-side annular member 225 is moved downward by the compression coil spring 239 and the rollers 227 are separated from the tapered surfaces 223*a*, 225*a*. At this time, the torque of the driving hub 223 is not transmitted to the driven-side annular member 225. This transmission interrupted state is a feature that corresponds to the "power transmission interrupted state" according to the present invention. In the power transmission interrupted state, when the trigger 209*a* is depressed to drive the driving motor 211, the driving gear 213 is caused to idle, and in the idling state, the driven-side annular member 225, the crank plate 241 and the abrasive part 205 are not rotationally driven.

In the idling state, when the abrasive surface of the abrasive part 205 is pressed against the workpiece by applying a downward force to the body 203, the abrasive part 205, the crank plate 241 and the driven-side annular member 225 are pushed together toward the body 203 while compressing the compression coil spring 239. Thus, the distance between the tapered surface 225*a* of the driven-side annular member 225 and the tapered surface 223*a* of the driving hub 223 is decreased in the radial direction. Therefore, the rollers 227 are pressed against the tapered surfaces 225*a*, 223*a* and serve as a wedge, so that frictional force is caused on contact surfaces between the rollers 227 and the tapered surfaces 225*a*, 223*a*. Thus, the rollers 227 which are held by the roller holding member 229 fixed to the body 203 are caused to rotate in the fixed position, so that the torque of the driving hub 223 is transmitted to the driven-side annular member 225. Specifically, the driven-side annular member 225 and the crank plate 241 connected to the driven-side annular member 225 are caused to rotate at reduced speed in a direction opposite to the direction of rotation of the driving hub 223. Then the abrasive part 205 which is attached to the crank plate 241 and can rotate in the eccentric position with respect to the crank plate 241 is caused to eccentrically rotate, and an abrasive operation by using the coated abrasive can be performed on the workpiece. The state in which the torque of the driving hub 223 is transmitted to the driven-side annular member 225 is a feature that corresponds to the "operating state" according to the present invention.

As described above, according to this embodiment, in the electric sander 201, the rollers 227 are disposed between the tapered surface 223*a* of the driving hub 223 and the tapered surface 225*a* of the driven-side annular member 225, and pressed against the tapered surfaces 223*a*, 225*a* by pressing the abrasive part 205 against the workpiece, so that frictional force is caused and the torque of the driving hub 223 is transmitted to the driven-side annular member 225. With such a construction, the pushing force of pushing the crank plate 241 in the axial direction is amplified to a force in a radial direction transverse to the axial direction of the crank plate 241 by the wedging effect, so that higher frictional force can be obtained and the power transmitting performance can be enhanced. Further, with the construction in which the abrasive part 205 is driven by pressing the abrasive part 205 against the workpiece, an abrasive operation can be performed with the abrasive surface pressed against the workpiece under a predetermined load.

Further, with the construction in which the power transmitting mechanism 211 according to this embodiment serves as both the friction clutch and the planetary gear speed reducing mechanism, the electric sander 201 can be provided in which the entire mechanism is reduced in size compared with a construction in which these two functions are separately provided.

Further, in the above-described embodiments, the electric screwdriver 101 and the electric sander 201 are explained as representative examples of the power tool, but the present invention is not limited to them and may be applied to any power tool having a power transmitting mechanism in which transmission of torque from a prime mover to a tool bit is interrupted when the tool bit is not pressed against a workpiece and the torque of the prime mover is transmitted to the tool bit when the tool bit is pressed against the workpiece. As for the prime mover, not only an electric motor but also an air motor may be used.

Having regard to the above-described invention, following aspects are provided.

(1)

"The power tool as defined in claim 5, wherein:

an outer circumferential surface of the sun member comprises a tapered surface, an inner circumferential surface of the driving-side member comprises a parallel surface, and the intervening member comprises a ball, the driven-side member is caused to move in the axial direction, and when the driven-side member moves in one direction along the axial direction, the intervening member is pushed in a radial direction by the tapered surface of the sun member and comes in frictional contact with the inner circumferential surface of the driving-side member, so that the intervening member transmits the torque of the driving-side member to the driven-side member, and when the driven-side member moves in the other direction, the frictional contact with the tapered surface of the sun member or the inner circumferential surface of the driving-side member is released so that the intervening member interrupts the torque transmission."

(2)

"The power tool as defined in claim 4, wherein:

the power transmitting mechanism comprises a sun member having an outer circumferential surface, an outer ring member that is disposed coaxially with the sun member and has an inner circumferential surface opposed to the outer circumferential surface of the sun member with a predetermined space, the intervening member in the form of the planetary member that is disposed between the outer circumferential surface of the sun member and the inner circumferential surface of the outer ring member, and a fixed carrier that is irrotationally supported and holds the planetary member, and the sun member and the outer ring member form the driving-side member and the driven-side member, respectively, and each of the outer circumferential surface of the sun member and the inner circumferential surface of the outer ring member is formed by a tapered surface."

(3)

"The power tool as defined in claim 2, wherein:

the driving-side member and the driven-side member are coaxially opposed to each other, and one of opposed surfaces of the driving-side member and the driven-side member has a concave tapered surface and the other has a convex tapered surface conforming to the concave tapered surface, and when the driven-side member moves in one direction along the axial direction, the tapered surfaces come in direct frictional contact with each other so that the torque of the driving-side member is transmitted to the driven-side member, and when the driven-side member moves in the other direction, the tapered surfaces are separated from each other so that the torque transmission is interrupted."

(4)

"The power tool as defined in claim 3, wherein:

the driving-side member has the tapered portion and the intervening member is supported on the driven-side member and can move in the radial direction, and when the driven-side member moves in one direction along the axial direction, the intervening member is inserted into the tapered portion and comes in frictional contact therewith, so that the torque of the driving-side member is transmitted to the driven-side member, and when the driven-side member moves in the other direction, the intervening member is separated from the tapered portion, so that the torque transmission is interrupted."

DESCRIPTION OF NUMERALS

101 screwdriver (power tool)
103 body (power tool body)
105 motor housing
107 gear housing
107*a* stopper
109 handgrip
109*a* trigger
111 driving motor (prime mover)
113 motor shaft
115 pinion gear
116 leaf spring
117 spindle
117*a* bit insertion hole
117*b* small-diameter shank
117*c* flange
117*d* spring receiving hole
117*e* rear end surface
118 ball
119 driver bit (tool bit)
119*a* small-diameter portion
121 bearing
123 locator
131 power transmitting mechanism
133 fixed hub
134 bearing
135 driving gear (driving-side member)
135*a* barrel part
135*b* teeth
135*c* bottom wall
137 roller (intervening member)
138 retainer ring
139 roller holding member
139*a* barrel part
141 bearing
143 bearing
145 roller installation groove
146 tapered surface of a fixed hub
147 tapered surface of a driving gear
149 compression coil spring
153 fixed hub
153*a* tapered surface
154 needle pin
155 driving gear (driving-side member)
155*a* teeth
155*b* inner circumferential surface
157 ball (intervening member)
158 compression coil spring
159 ball holding member (driven-side member)
159*a* cylindrical body
161 fixed hub
162 bearing
163 driving gear (driving-side member)
164 cylindrical portion
164*a* tapered surface
165 driven-side cylindrical portion (driven-side member)
165*a* tapered surface
166 thrust bearing
167 roller (intervening member)
168 compression coil spring
169 roller holding member
169*a* boss part
169*b* barrel pail
169*e* roller installation groove
171 driving-side clutch (driving-side member)
171*a* tapered surface
172 teeth
173 driven-side clutch (driven-side member)
173*a* tapered surface
175 clutch shaft
176 bearing
177 thrust bearing
178 compression coil spring
181 driving gear (driving-side member)
182 cylindrical portion
182*a* inner circumferential surface
183 gear shaft
183*a* tapered surface
184 bearing
185 driven-side barrel part
186 thrust bearing
187 brake shoe
187*a* recess
188 ring spring

189 compression coil spring
201 electric sander (power tool)
203 body (power tool body)
205 abrasive part
207 coated abrasive
208 auxiliary grip
209 handgrip
209*a* trigger
211 driving motor (prime mover)
213 motor shaft
214 bearing
221 power transmitting mechanism
223 driving hub (driving-side member)
223*a* tapered surface
225 driven-side annular member (driven-side member)
225*a* tapered surface
225*b* engagement surface
225*c* flange
227 roller (intervening member)
229 roller holding member
231 barrel part
233 flange
235 screw
237 suspending member
238 thrust bearing
239 compression coil spring
241 crank plate
243 screw
245 bearing

What we claim is:

1. A power tool which performs a predetermined operation on a workpiece by driving a tool bit comprising:

a prime mover that drives the tool bit, and a power transmitting mechanism that transmits torque of the prime mover to the tool bit, wherein:

the power transmitting mechanism has a driving-side member which is rotationally driven by the prime mover, and a driven-side member to which the tool bit is coupled, and when the tool bit is not pressed against the workpiece, the power transmitting mechanism is held in a power transmission interrupted state in which torque of the driving-side member is not transmitted to the driven-side member, and when the tool bit is pressed against the workpiece, the power transmitting mechanism is held in a power transmission state in which the tool bit moves together with the driven-side member in an axial direction of the tool bit so that the driven-side member receives the torque from the driving-side member and the tool bit is driven, and a tapered portion is provided between the driving-side member and the driven-side member and inclined with respect to the axial direction of the tool bit, and when the driven-side member moves in the axial direction of the tool bit, frictional force is caused on the tapered portion and the torque of the driving-side member is transmitted to the driven-side member by the frictional force, wherein an intervening member is provided between the driving-side member and the driven-side member and can be engaged with the both members, and the torque of the driving-side member is transmitted to the driven-side member via the intervening member by frictional contact of the intervening member with the tapered portion.

2. The power tool as defined in claim 1, wherein:

the driving-side member has the tapered portion and the intervening member is supported on the driven-side member and can move in the radial direction, and when the driven-side member moves in one direction along the axial direction, the intervening member is inserted into the tapered portion and comes in frictional contact therewith, so that the torque of the driving-side member is transmitted to the driven-side member, and when the driven-side member moves in the other direction, the intervening member is separated from the tapered portion, so that the torque transmission is interrupted.

3. The power tool as defined in claim 1, wherein the intervening member comprises a planetary member that revolves around an axis of the driving-side member, and the driven-side member is rotated by revolving movement of the intervening member.

4. The power tool as defined in claim 3, wherein the power transmitting mechanism comprises a fixed sun member having an outer circumferential surface, an outer ring member that is disposed coaxially with the sun member and has an inner circumferential surface opposed to the outer circumferential surface of the sun member with a predetermined space, the intervening member in the form of the planetary member that is disposed between the outer circumferential surface of the sun member and the inner circumferential surface of the outer ring member and can revolve on the outer circumferential surface of the sun member, and a carrier that holds the planetary member, and wherein the outer ring member and the carrier form the driving-side member and the driven-side member, respectively, and the tapered portion is provided between the sun member and the driving-side member.

5. The power tool as defined in claim 4, wherein the outer circumferential surface of the sun member comprises a tapered surface, the inner circumferential surface of the driving-side member comprises a tapered surface, and the intervening member comprises a cylindrical roller, the driving-side member and the driven-side member are caused to move together in the axial direction, and when the driving-side member and the driven-side member move in one direction along the axial direction, the intervening member comes in frictional contact with the tapered surface of the sun member and the inner circumferential surface of the driving-side member, so that the intervening member transmits the torque of the driving-side member to the driven-side member, and when the driving-side member and the driven-side member move in the other direction, the frictional contact with the tapered surface of the sun member or the tapered surface of the driving-side member is released so that the intervening member interrupts the torque transmission.

6. The power tool as defined in claim 4, wherein:

an outer circumferential surface of the sun member comprises a tapered surface, an inner circumferential surface of the driving-side member comprises a parallel surface, and the intervening member comprises a ball, the driven-side member is caused to move in the axial direction, and when the driven-side member moves in one direction along the axial direction, the intervening member is pushed in a radial direction by the tapered surface of the sun member and comes in frictional contact with the inner circumferential surface of the driving-side member, so that the intervening member transmits the torque of the driving-side member to the driven-side member, and when the driven-side member moves in the other direction, the frictional contact with the tapered surface of the sun member or the inner circumferential surface of the driving-side member is released so that the intervening member interrupts the torque transmission.

7. The power tool as defined in claim 3, wherein:

the power transmitting mechanism comprises a sun member having an outer circumferential surface, an outer ring member that is disposed coaxially with the sun member and has an inner circumferential surface opposed to the outer circumferential surface of the sun member with a predetermined space, the intervening member in the form of the planetary member that is disposed between the outer circumferential surface of the sun member and the inner circumferential surface of the outer ring member, and a fixed carrier that is irrotationally supported and holds the planetary member, and the sun member and the outer ring member form the driving-side member and the driven-side member, respectively, and each of the outer circumferential surface of the sun member and the inner circumferential surface of the outer ring member is formed by a tapered surface.

8. The power tool as defined in claim 1, wherein the power tool is a screw tightening tool having the tool bit in the form of a driver bit that performs a screw tightening operation on a workpiece, the power tool including a tool body and a locator that is disposed on a front end of the tool body and regulates a penetration depth of a screw to be tightened by the driver bit, and wherein, in the screw tightening operation, when the locator comes in contact with the workpiece, the driven-side member is moved forward together with the driver bit so that frictional force on the tapered portion is released.

9. The power tool as defined in claim 1, wherein the power tool is an abrasive tool having the tool bit in the form of an abrasive that performs an abrasive operation on a workpiece.

* * * * *